US010464074B2

(12) United States Patent
Lee et al.

(10) Patent No.: US 10,464,074 B2
(45) Date of Patent: Nov. 5, 2019

(54) ELECTRIC DUST COLLECTOR AND AIR CONDITIONER INCLUDING THE SAME

(71) Applicant: LG ELECTRONICS INC., Seoul (KR)

(72) Inventors: Yanghwa Lee, Seoul (KR); Taeyoon Kim, Seoul (KR); Hooncheol Jeon, Seoul (KR); Inho Choi, Seoul (KR); Jieun Choi, Seoul (KR); Sanghyuk Son, Seoul (KR); Kyoungho Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 274 days.

(21) Appl. No.: 15/338,286

(22) Filed: Oct. 28, 2016

(65) Prior Publication Data

US 2017/0120257 A1 May 4, 2017

Related U.S. Application Data

(60) Provisional application No. 62/248,463, filed on Oct. 30, 2015, provisional application No. 62/252,017, filed on Nov. 6, 2015.

(30) Foreign Application Priority Data

Dec. 24, 2015 (KR) ..... 10-2015-0185841
Mar. 28, 2016 (KR) ..... 10-2016-0037255

(51) Int. Cl.
*B03C 3/82* (2006.01)
*B03C 3/41* (2006.01)
(Continued)

(52) U.S. Cl.
CPC ..... *B03C 3/82* (2013.01); *B03C 3/41* (2013.01); *B03C 3/45* (2013.01); *B03C 3/47* (2013.01); *B03C 3/86* (2013.01)

(58) Field of Classification Search
CPC combination set(s) only.
See application file for complete search history.

(56) References Cited

U.S. PATENT DOCUMENTS 2,873,000 A 2/1959 Elam
3,027,970 A 4/1962 Mueller
(Continued)

FOREIGN PATENT DOCUMENTS

CN 1233535 A 11/1999
CN 101745462 A 6/2010
(Continued)

*Primary Examiner* — Amber R Orlando
*Assistant Examiner* — Sonji Turner
(74) *Attorney, Agent, or Firm* — Dentons US LLP

(57) ABSTRACT

The electric dust collector includes a dust collection unit for collecting electrified dust particles and a dust collection unit case for receiving the dust collection unit. The dust collection unit includes a plurality of films for generating an electric field and a fixing part for fixing the films in the dust collection unit case. Each of the films is formed in the shape of a band that is longer in the longitudinal direction than in the lateral direction, and the films are arranged so as to face each other such that gaps are formed between the respective films. The fixing part includes a gap maintenance part disposed on at least one side of a group of films in the lateral direction for maintaining the gaps. The gap maintenance part includes a plurality of vertical bars to be inserted into the gaps from the one side of the group of films.

20 Claims, 32 Drawing Sheets

(51) Int. Cl.

| | |
|---|---|
| ***B03C 3/45*** | (2006.01) |
| ***B03C 3/47*** | (2006.01) |
| ***B03C 3/86*** | (2006.01) |

(56) References Cited

U.S. PATENT DOCUMENTS

| | | | | |
|---|---|---|---|---|
| 4,478,614 | A * | 10/1984 | Jonelis | B03C 3/86 96/87 |
| 7,531,028 | B2 * | 5/2009 | Mello | B03C 3/09 96/55 |
| 7,608,135 | B2 * | 10/2009 | Mello | B03C 3/09 96/59 |
| 7,914,604 | B2 * | 3/2011 | Mello | B03C 3/09 95/69 |
| 8,491,709 | B2 | 7/2013 | Takeuchi et al. | |
| 9,795,971 | B2 * | 10/2017 | Shao | B03C 3/64 |
| 2003/0005824 | A1 * | 1/2003 | Katou | B03C 3/12 96/35 |
| 2010/0132562 | A1 | 6/2010 | Noh et al. | |
| 2010/0263530 | A1 * | 10/2010 | Mello | B03C 3/09 95/79 |
| 2012/0312170 | A1 | 12/2012 | Noh et al. | |
| 2014/0345463 | A1 * | 11/2014 | Urata | B03C 3/08 96/21 |
| 2015/0266033 | A1 * | 9/2015 | Shao | B03C 3/64 96/99 |

FOREIGN PATENT DOCUMENTS

| | | | |
|---|---|---|---|
| CN | 102218373 | A | 10/2011 |
| CN | 102814234 | A | 12/2012 |
| CN | 203886676 | U | 10/2014 |
| CN | 104785371 | A | 7/2015 |
| EP | 2 468 411 | A2 | 6/2012 |
| JP | 2004-174456 | A | 6/2004 |
| JP | 2009-95799 | A | 5/2009 |
| KR | 10-1998-0702069 | A | 7/1998 |
| KR | 10-1999-0045462 | A | 6/1999 |
| KR | 20-2009-0009549 | U | 9/2009 |
| KR | 10-2010-0062118 | A | 6/2010 |
| KR | 20-2011-0002365 | U | 3/2011 |
| KR | 10-2011-0088742 | A | 8/2011 |
| KR | 10-2012-0136795 | A | 12/2012 |
| WO | 2010/085253 | A1 | 7/2010 |

* cited by examiner

ELECTRIC DUST COLLECTOR AND AIR CONDITIONER INCLUDING THE SAME

CROSS-REFERENCE TO RELATED APPLICATION

This application claims the priority benefit of U.S. Provisional Application No. 62/248,463, filed on Oct. 30, 2015, U.S. Provisional Application No. 62/252,017, filed on Nov. 6, 2015, Korean Patent Application No. 10-2015-0185841, filed on Dec. 24, 2015, and Korean Patent Application No. 10-2016-0037255, filed on Mar. 28, 2016, the disclosure of which are incorporated herein by reference.

BACKGROUND OF THE INVENTION

1. Field of the Invention

The present invention relates to an electric dust collector including a plurality of films for generating an electric field to collect electrified dust particles and a structure for maintaining the gaps between the films and an air conditioner including the same.

2. Description of the Related Art

An air conditioner is classified as a cooler or a heater for controlling the temperature of air, an air freshener for removing foreign matter from air to maintain cleanliness of the air, a humidifier for supplying moisture to air, or a dehumidifier for removing moisture from air.

An electric dust collector is a stand-alone device or a device mounted in an air conditioner for electrifying and collecting dust particles in the air.

The electric dust collector mainly includes an electrification unit for generating an electric field and a dust collection unit for collecting dust particles electrified by the electrification unit. While air passes through the dust collection unit after passing through the electrification unit, dust in the air is collected by the dust collection unit.

The electrification unit includes discharge electrodes and opposite electrodes arranged parallel to the discharge electrodes. Dust is electrified as the result of corona discharge between the discharge electrodes and the opposite electrodes.

SUMMARY OF THE INVENTION

In the conventional art, protrusions are provided at opposite ends of films in the lateral direction. The protrusions provided at one end of the films are fixed to a first structure adjacent to the one end of the group of films, and the protrusions provided at the other end of the films are fixed to a second structure adjacent to the other end of the group of films. When the films are coupled to the first structure and the second structure, considerable effort or accuracy is required to engage the protrusions with each other on the opposite ends of the films. It is a first object of the present invention to solve this problem.

In the conventional art, the protrusions arranged along the opposite ends of the films in the lateral direction are arranged so as to be supported on the opposite ends of the films in the lateral direction in order to maintain gaps between the films (e.g. high-potential electrodes and low-potential electrodes). In this case, however, the middle portions of the films, which are distant from the opposite ends of the films, may be curved, with the result that it is difficult to maintain the gaps between films. Consequently, an electric field may be non-uniformly and inefficiently generated. It is a second object of the present invention to solve this problem.

It is a third object of the present invention to provide a gap maintenance structure for maintaining the gaps between the films, the gap maintenance structure being easily assembled.

An electric dust collector according to the present invention includes a dust collection unit to collect electrified dust particles and a dust collection unit case receiving the dust collection unit.

In accordance with first to third aspects of the present invention, the dust collection unit includes a plurality of films to generate an electric field and a fixing part fixing the films in the dust collection unit case. Each of the films is formed in the shape of a band that is longer in the longitudinal direction than in the lateral direction, and the films are arranged to face each other such that gaps are formed between the respective films. The fixing part includes a gap maintenance part disposed on at least one side of a group of films in the lateral direction for maintaining the gaps. The gap maintenance part includes a plurality of vertical bars inserted into the gaps from the one side of the group of films.

The gap maintenance part may include a plurality of gap maintenance parts arranged to be spaced apart from each other in the longitudinal direction of the films. The films may be arranged side by side to face each other.

Each of vertical bars may be provided with protrusions protruding toward surfaces of the films for reducing the gaps between the films.

The gap maintenance part may include a pair of gap maintenance parts disposed on opposite sides of the group of films in the lateral direction for maintaining the gaps.

The gap maintenance part may include a base gap maintenance part disposed at one side of the group of films in the lateral direction and a roof gap maintenance part disposed at the other side of the group of films in the lateral direction. The base gap maintenance part may include a plurality of first vertical bars inserted into the gaps from the one side of the group of films. The roof gap maintenance part may include a plurality of second vertical bars inserted into the gaps from the other side of the group of films.

The base gap maintenance part and the roof gap maintenance part may be arranged to be symmetric with respect to the middle portion of the group of films in the lateral direction.

The base gap maintenance part and the roof gap maintenance part may have the same shape.

Each of the first and second vertical bars may be provided with protrusions protruding toward the surfaces of the films for reducing the gaps between the films.

The base gap maintenance part may include a first gap maintenance body covering opposite ends of the group of films in the direction in which the films are arranged and one side of the group of films and supporting proximal ends of the first vertical bars. The roof gap maintenance part may include a first gap maintenance body covering opposite ends of the group of films in the direction in which the films are arranged and the other side of the group of films and supporting proximal ends of the second vertical bars.

The first gap maintenance body may include first opposite end support parts disposed at the opposite ends of the group of films in the direction in which the films are arranged and coupled to the dust collection unit case. The second gap maintenance body may include second opposite end support parts disposed at the opposite ends of the group of films in the direction in which the films are arranged and coupled to the dust collection unit case.

The first gap maintenance body may include a first horizontal bar extending in the direction in which the films are arranged while contacting the group of films. The second gap maintenance body may include a second horizontal bar extending in the direction in which the films are arranged while contacting the group of films.

The first gap maintenance body may include a first fastening part for fixing the base gap maintenance part to the dust collection unit case. The second gap maintenance body may include a second fastening part for fixing the roof gap maintenance part to the dust collection unit case. The dust collection unit case may include a hook on which the first fastening parts and the second fastening part are caught in the state in which the first fastening parts and the second fastening part contact each other.

The vertical bars may be inserted into the gaps further inward than middle portions of the films in the lateral direction.

The gap maintenance part may include a base gap maintenance part disposed at one side of the group of films in the lateral direction and a roof gap maintenance part disposed at the other side of the group of films in the lateral direction. The base gap maintenance part may include a plurality of base vertical bars inserted into the gaps from the one side of the group of films in the lateral direction. The roof gap maintenance part may include a plurality of roof vertical bars inserted into the gaps from the other side of the group of films in the lateral direction. The base vertical bars and the roof vertical bars may be inserted into the gaps further inward than middle portions of the films in the lateral direction.

The base gap maintenance part may include a plurality of base gap maintenance parts and/or the roof gap maintenance part may include a plurality of roof gap maintenance parts. At least of the base gap maintenance part and the roof gap maintenance part is a plural.

The base gap maintenance parts and the roof gap maintenance parts may be alternately arranged to be spaced apart from each other in the longitudinal direction of the films.

The roof gap maintenance part may include a roof body covering opposite ends of the group of films in the direction in which the films are arranged and the other side of the group of film and supporting proximal ends of the roof vertical bars.

The gap maintenance part may include a roof gap maintenance part disposed at one of the opposite sides of the group of films in the lateral direction that is more distant from the inner surface of the dust collection unit case than the other. The roof gap maintenance part may include a roof body for covering opposite ends of the group of films in the direction in which the films are arranged and the more distant side of the group of film. (The roof gap maintenance part may include a roof body for covering opposite ends of the group of films in the direction in which the films are arranged and the one side of the group of film.)

The roof body may include opposite end support parts disposed at the opposite ends thereof in the direction in which the films are arranged, the opposite end support parts coupled to the dust collection unit case. The roof body may include a roof bar extending in the direction in which the films are arranged while contacting the group of films.

The roof bar may include at least one enlarged section part having a larger thickness than other parts.

The fixing part may include a molding part formed by hardening predetermined paste in the state in which a portion of each of the films is immersed in the paste for fixing the films.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
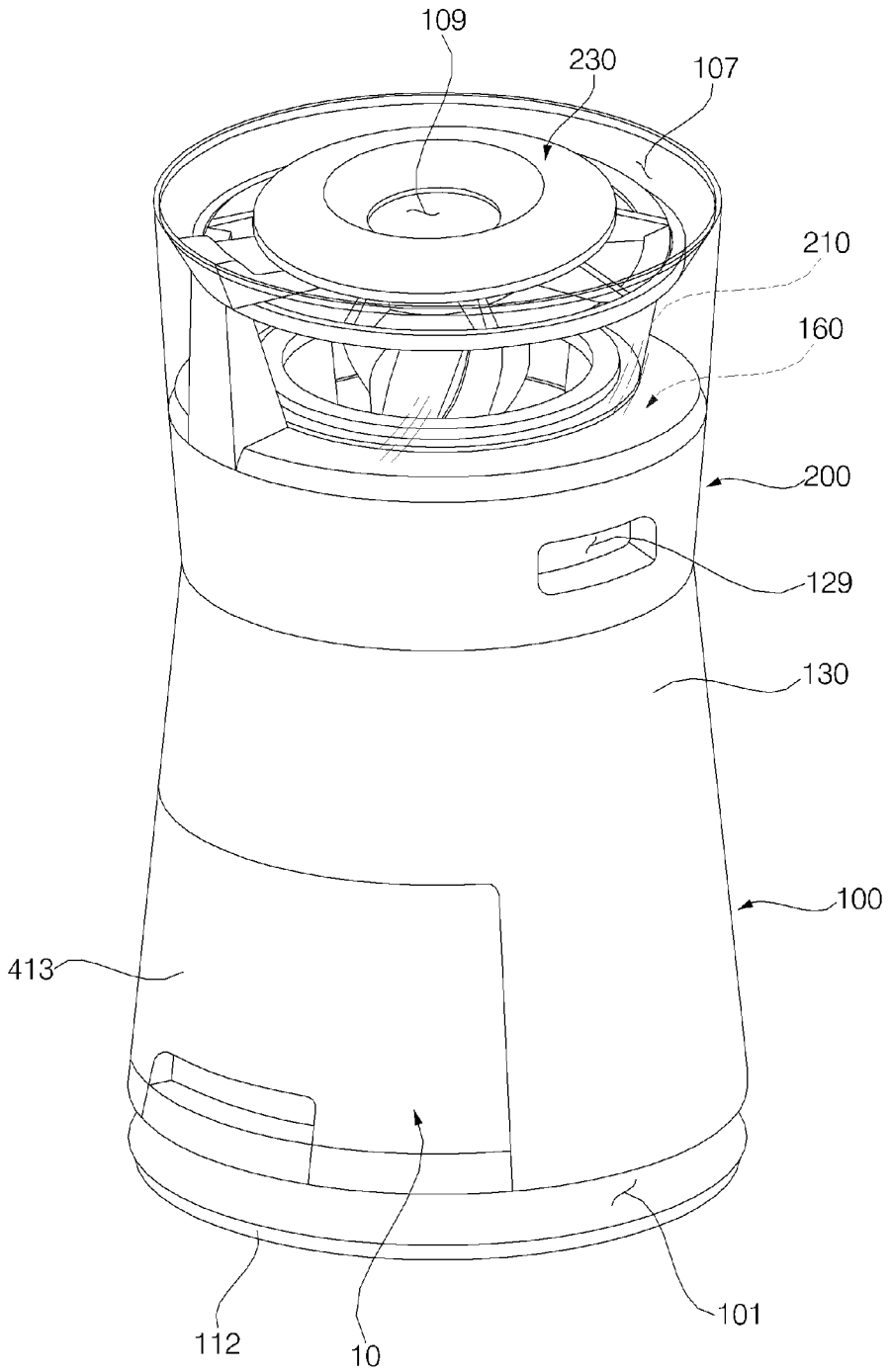
FIG. 1 is a perspective view showing an air conditioner according to an embodiment of the present invention.

Exemplary embodiments of the present invention will be described with reference to the attached drawings.

In the drawings, the X-axis direction means the direction in which films of a dust collection unit, a description of which will follow, are alternately arranged, the Y-axis direction means the longitudinal direction of the films, and the Z-axis direction means the lateral direction of the films. In this embodiment, the X-axis direction, the Y-axis direction, and the Z-axis direction are perpendicular to each other. In this embodiment, the Z-axis direction is the upward-downward direction (specifically, the Z-axis direction indicated by the forward direction of the arrow is the upward direction and the Z-axis direction indicated by the reverse direction of the arrow is the downward direction). Alternatively, the X-axis direction or the Y-axis direction may be the upward-downward direction. The upward-downward direction may not be the vertical direction, i.e. may be inclined.

In the following description, the term "potential" means electrical potential energy. In the following description, the term "voltage" means the potential difference between two points.

An electric dust collector according to the present invention may be used as a component of an air conditioner, an air freshener, or a humidifier, or may be used as a stand-alone device for dust collection. In the specification, an electric dust collector is described as being mounted in an air conditioner including an air freshener and a humidifier. However, the present invention is not limited thereto.

Figure 2:
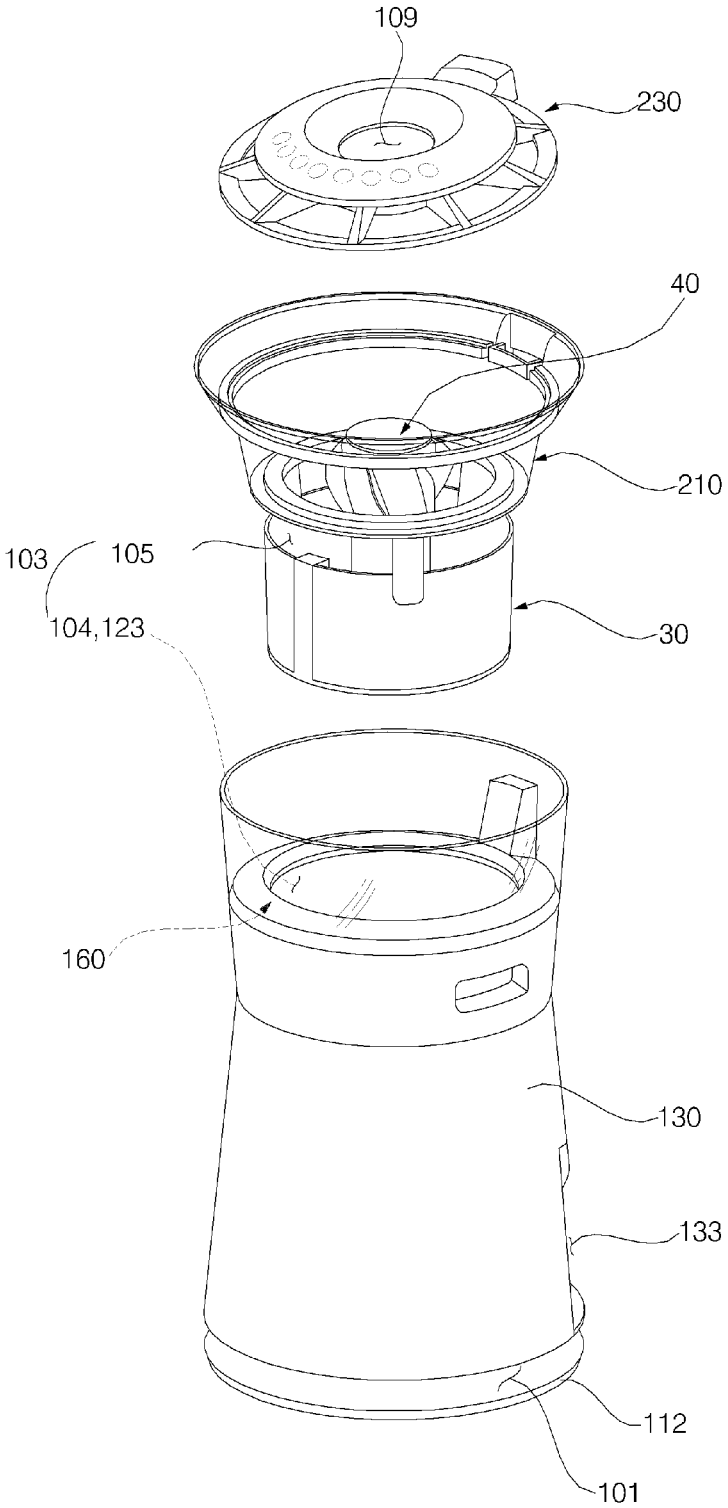
FIG. 2 is an exploded perspective view showing a humidifier of FIG. 1.
Figure 3:
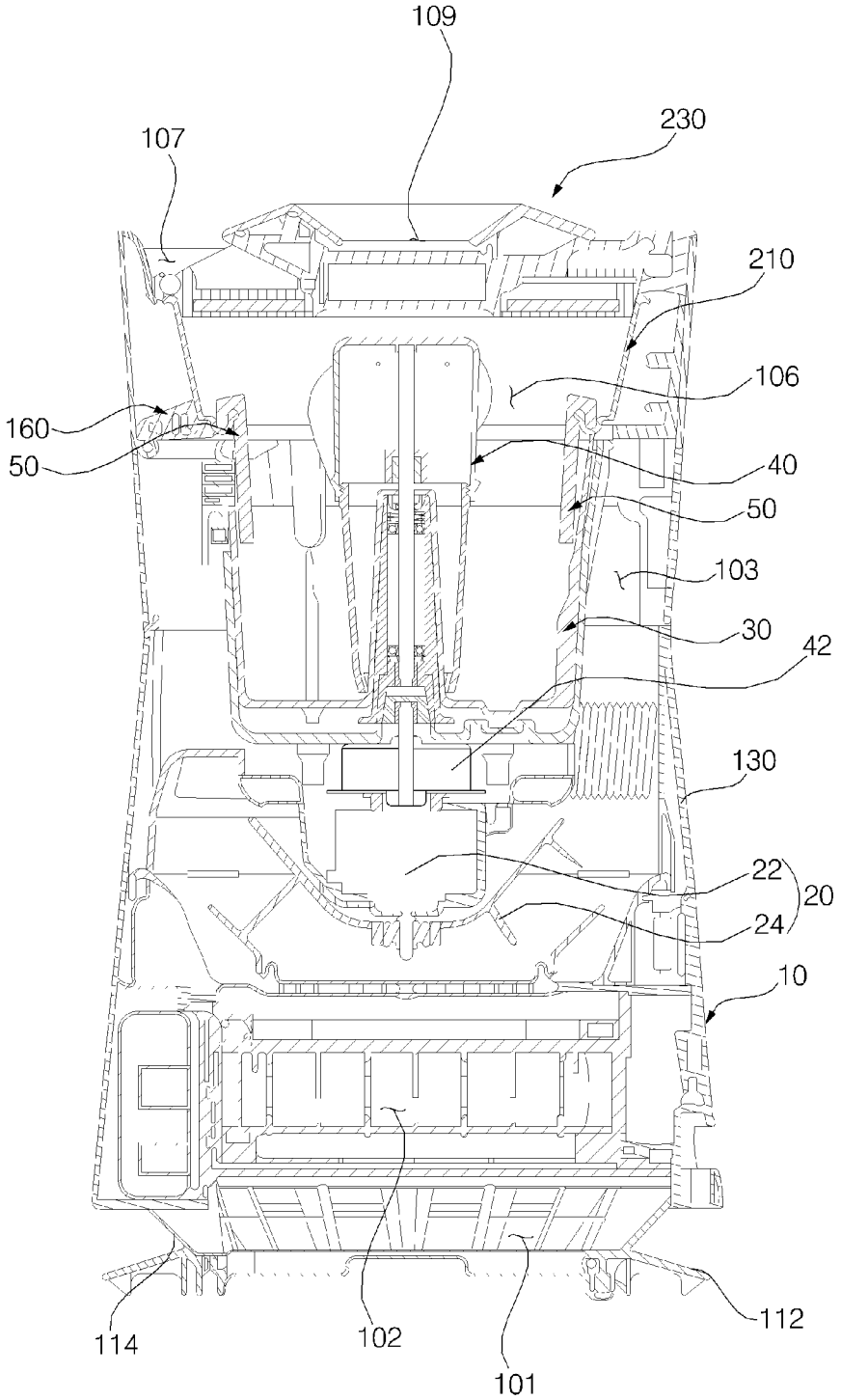
FIG. 3 is a vertical sectional view showing the air conditioner of FIG. 1.
Figure 4:
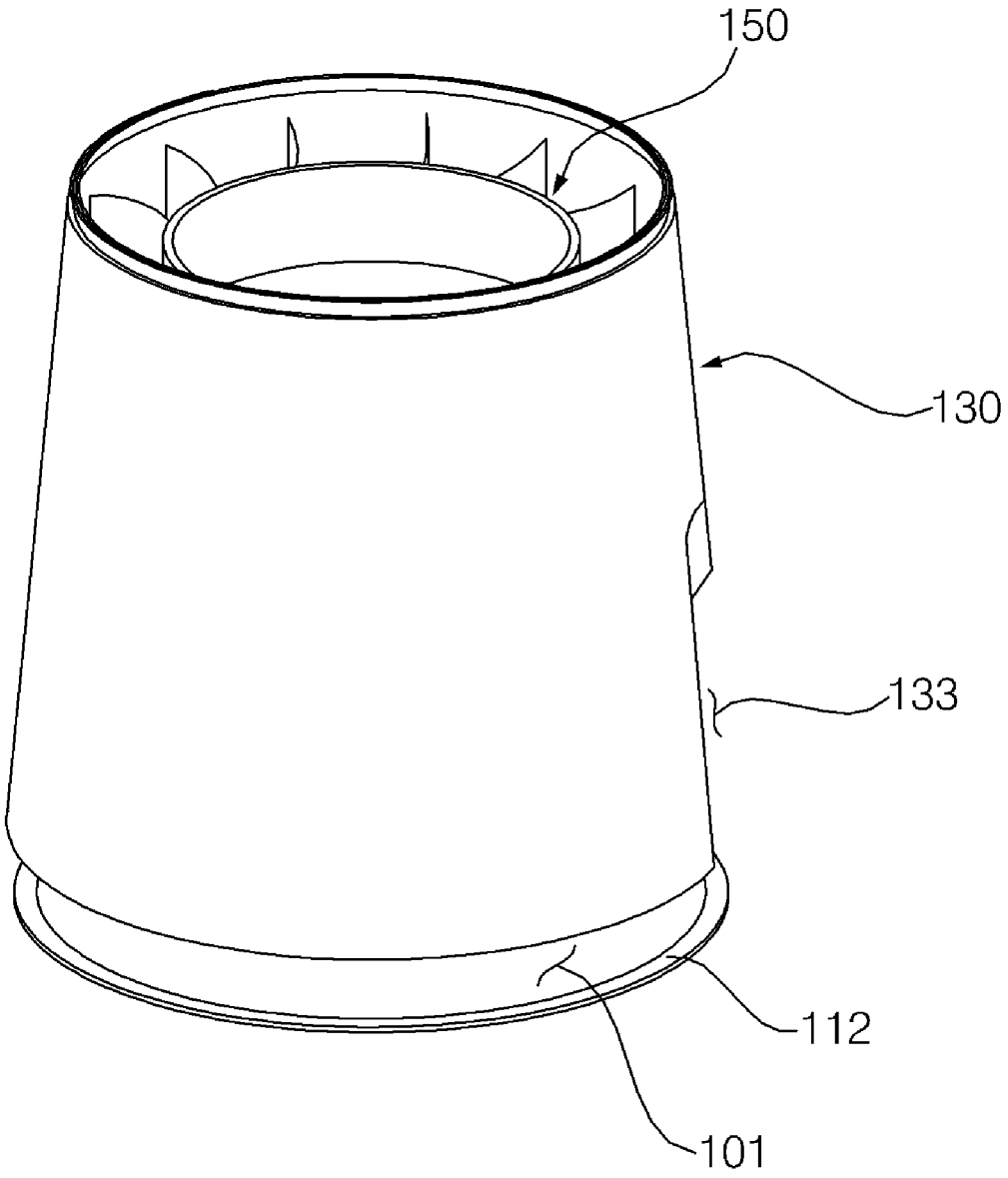
FIG. 4 is a perspective view showing a body of FIG. 1.
Figure 5:
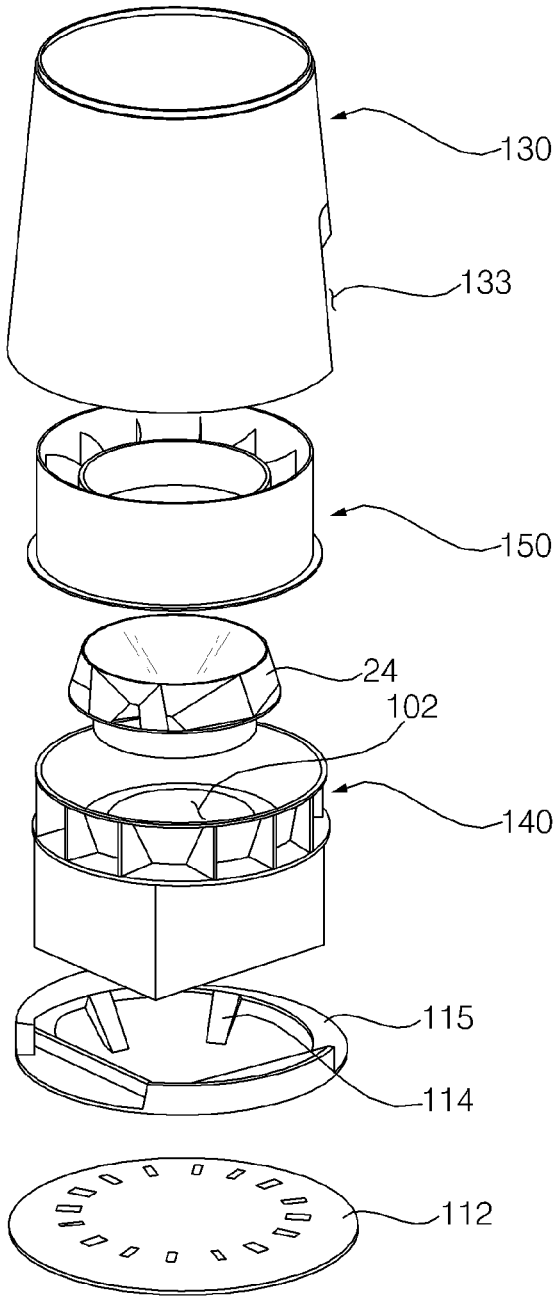
FIG. 5 is an exploded perspective view showing the body of FIG. 4.

FIG. 1 is a perspective view showing an air conditioner according to an embodiment of the present invention, FIG. 2 is an exploded perspective view showing a humidifier 200 of FIG. 1, FIG. 3 is a vertical sectional view showing the air conditioner of FIG. 1, FIG. 4 is a perspective view showing a body 130 of FIG. 1, and FIG. 5 is an exploded perspective view showing the body 130 of FIG. 4.

Referring to FIGS. 1 to 5, an air conditioner according to an embodiment of the present invention includes an air freshener 100 and a humidifier 200 mounted at the upper side of the air freshener 100. The air freshener 100 is disposed on the floor, and the humidifier 200 is disposed on the air freshener 100.

The air freshener 100 filters external air introduced thereinto, and supplies the filtered air to the humidifier 200. The air freshener 100 filters external air introduced thereinto to remove foreign matter and bad smells from the air and supplies the filtered air to the humidifier 200. The humidifier 200 humidifies the filtered air, and discharges the humidified air to the outside.

The humidifier 200 may be separated from the air freshener 100. A user may separate the humidifier 200 and the air freshener 100 from each other to clean the humidifier 200 and the air freshener 100. After the humidifier 200 is separated from the air freshener 100, the user may supply water into a water tank 30 disposed in the humidifier 200. The user may supply water to the humidifier 200 in the state in which the humidifier 200 is disposed on the air freshener 100.

The air freshener 100 has a suction channel 101, through which external air is suctioned into the air freshener 100 and a filtration channel 102, through which the suctioned air is filtered.

In the state in which the humidifier 200 is disposed on the air freshener 100, a connection channel 103 for supplying the filtered air to the air freshener 100 and the humidifier 200 is formed. A portion of the connection channel 103 formed in the air freshener 100 is defined as a cleaning connection channel 104, and a portion of the connection channel 103 formed in the humidifier 200 is defined as a humidification connection channel 105.

The cleaning connection channel 104 or the humidification connection channel 105 may be formed so as to have an additional space. In this embodiment, the cleaning connection channel 104 or the humidification connection channel 105 does not have an additional space, but the connection channel 103 is formed between the humidifier 200 and the air freshener 100 in the state in which the humidifier 200 is disposed on the air freshener 100

The humidifier 200 has a humidification channel 106, through which the air having passed through the air freshener 100, i.e. the filtered air, is humidified. While passing through the humidification channel 106, the filtered air is humidified. A discharge channel 107 is formed at the downstream side of the humidification channel 106 such that the air treated by the air freshener 100 and the humidifier 200 is discharged to the outside through the discharge channel 107.

In this embodiment, air generally flows upward in the air freshener 100 and the humidifier 200, although the direction in which air flows is changed somewhat in the air freshener 100 and the humidifier 200.

The air freshener 100 includes a body 130 for guiding the air suctioned through the suction channel 101 to the humidifier 200, a filter assembly 10 separably installed in the body 130 for filtering the suctioned air, and a blowing unit 20 disposed in the body 130 for providing pressure enabling the suctioned air to flow.

The air freshener 100 is installed on a base 112. The air freshener 100 is spaced apart from the base 112 to define the suction channel 101. Since the air freshener 100 is spaced apart from the base 112, external air may be suctioned through the entirety of the lower surface of the air freshener 100. The air suctioned from the lower side of the air freshener 100 flows vertically to the upper side of the air freshener 100.

The body 130 defines the external appearance of the air freshener 100.

The body 130 may include a display module 160 for indicating the operational state of the air freshener 100.

The body 130 has a circular section. The body 130 is provided with a grip 129.

The filter assembly 10 is separately coupled to the body 130. The filter assembly 10 may be separated from the body 130 in the horizontal direction. The filter assembly includes a plurality of filters installed in the horizontal direction and a plurality of filters stacked in the vertical direction, a detailed description of which will follow.

A filter housing 140, in which the filter assembly 10 is separably received, is installed in the body 130. The filter housing 140 is fixed in the body 130.

The filter housing 140 and the filter assembly 10 are coupled to each other to define the filtration channel 102. The upstream side of the filtration channel 102 is connected to the suction channel 101. The downstream side of the filtration channel 102 is connected to the connection channel 103. Specifically, the downstream side of the filtration channel 102 is connected to the cleaning connection channel 104.

The filter installation opening 133 is formed in one side of the body 130. The filter assembly 10 is inserted into the filter housing 140 through the filter installation opening 133. The filter assembly 10 includes a filter cover 413 for covering the filter installation opening 133.

A blowing unit housing 150 for guiding air blown by the blowing unit 20 to the humidifier 200 is installed in the body 130. The blowing unit housing 150 is located at the upper side of the filter housing 140. The blowing unit housing 150 is fastened and fixed to the filter housing 140.

The blowing unit 20 is installed between the filter housing 140 and the blowing unit housing 150. The blowing unit 20 provides pressure enabling air to flow.

External air is suctioned through the suction channel 101 in all directions of 360 degrees. A bridge frame 115 is provided between the body 130 and the base 112 such that the body 130 is spaced apart from the base 112. The bridge frame 115 couples the body 130 to the base 112 and supports the body 130.

The external air flows to a suction port 111 via the bridge frame 115. A plurality of bridges 114 is formed on the bridge frame 115 so as to extend upward and downward. The bridges 114 may be disposed close to each other so as to prevent a user's finger from entering the suction port 111. The number of bridges 114 may be minimized in consideration of air resistance.

The filter assembly 10 is disposed perpendicular to the flow of air. The filter assembly 10 intersects the filtration channel 102. The filtration channel 102 extends in the vertical direction, and the filter assembly 10 is installed in the horizontal direction. The function of the filter assembly 10 is sufficiently performed when the filter assembly intersects the filtration channel 102.

The filtration channel 102 extends upward against gravity. The filtration channel 102 extends in a straight line without being bent.

The air suctioned through the suction channel 101 flows to the blowing unit 20 via the filter housing 140. The blowing unit 20 is disposed at the upper side of the filter housing 140. The blowing unit 20 suctions the air from the filtration channel 102 and discharges the suctioned air to the humidifier 200.

The blowing unit 20 includes a blowing motor 22 and a blowing fan 24. In this embodiment, the blowing motor 22 and the blowing fan 24 are disposed between the blowing unit housing 150 and the filter housing 140. The blowing motor 22 is disposed above the blowing fan 24.

The blowing motor 22 is installed at the blowing unit housing 150 so as to be supported by the blowing unit housing 150. The blowing fan 24 is assembled with the blowing motor 22. The blowing fan 24 is rotated by driving force of the blowing motor 22. The blowing fan 24 is disposed at the filter housing 140.

In order to minimize installation spaces, at least a portion of the blowing motor 22 may be inserted into the blowing unit housing 150, and at least a portion of the blowing fan 24 may be inserted into the filter housing 140.

The filtered air is suctioned into the blowing fan 24 through the center thereof, and is discharged from the blowing fan 24 in the circumferential direction. In this embodiment, the blowing motor 22 is disposed at the upper side of the blowing fan 24 in order to prevent interference with air. The blowing motor 22 is installed so as to deviate from the air channels.

The air discharged from the blowing fan 24 flows upward to the humidifier 200 via the filter housing 140 and the blowing unit housing 150.

The water tank 30 is disposed in the body 130 at the upper side of the blowing unit 20. The body 130 is provided with a water tank insertion space which is concave inward from the upper side thereof such that the water tank 30 can be inserted from above.

A humidification channel inlet 123, through which air passes, is formed in the circumference of the water tank insertion space. The humidification channel inlet 123 communicates with the interior of the water tank 30. In this embodiment, a humidification medium 50 containing a moisture source is disposed inside the humidification channel inlet 123.

A watering unit 40 for suctioning water from the water tank 30, raising the suctioned water upward, and spraying the raised water to the outside is installed in the water tank 30. A watering motor 42, which is the power source of the watering unit 40, is installed at the lower side of the water tank 30. The watering motor 42 is physically separated from the blowing motor 22. The blowing motor 22 and the watering motor 42 may be independently controlled.

The humidifier 200 includes a visible body 210 separably stacked on the air freshener 100, the visible body 210 being made of a see-through material, and a top cover assembly 230 separably coupled to the visible body 210. In this embodiment, the discharge channel 107 is defined between the top cover assembly 230 and the visible body 210. The discharge channel 107 is connected to the downstream side of the humidification channel 106. The connection channel 103 is connected to the upstream side of the humidification channel 106. The top cover assembly 230 is provided with a water supply channel 109, through which external water is supplied to the humidifier 200.

Figure 6:
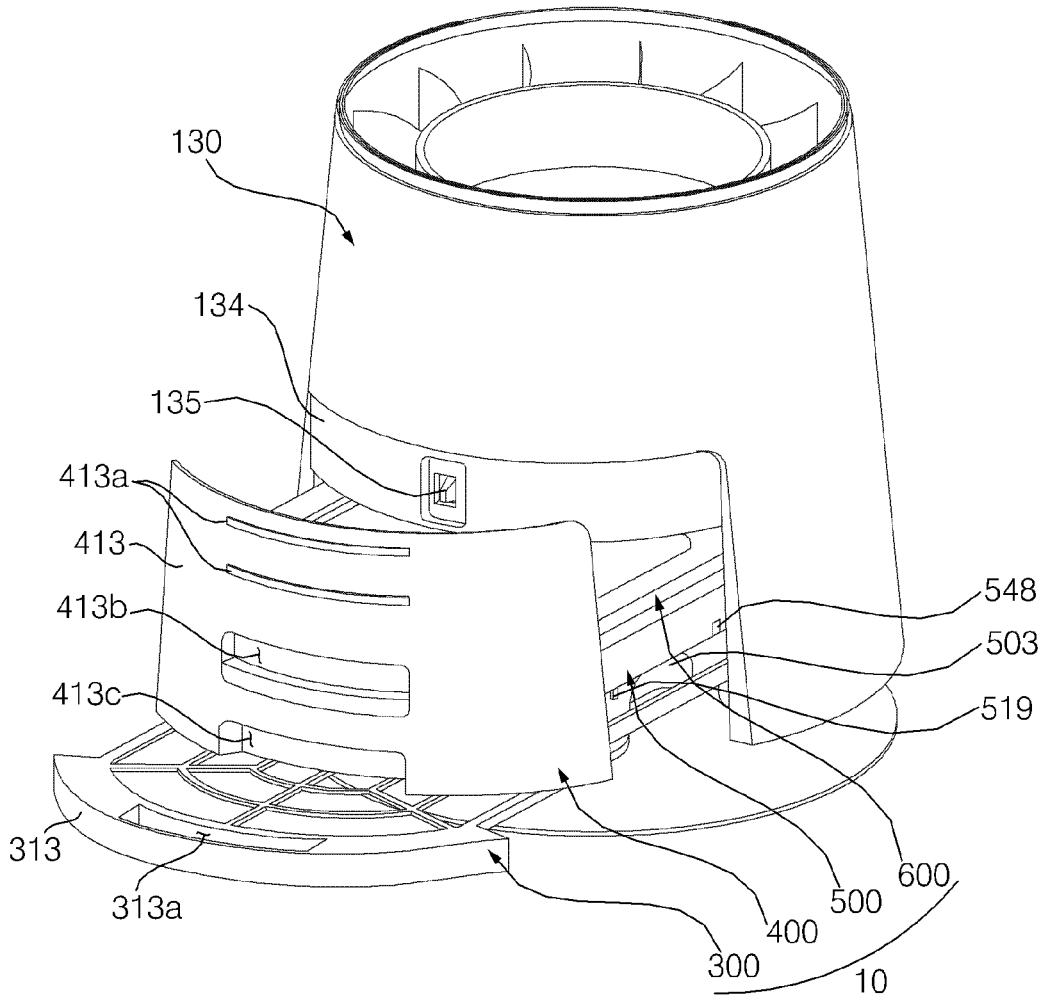
FIG. 6 is a perspective view showing the body of FIG. 1 and a filter assembly separably coupled thereto.
Figure 7:
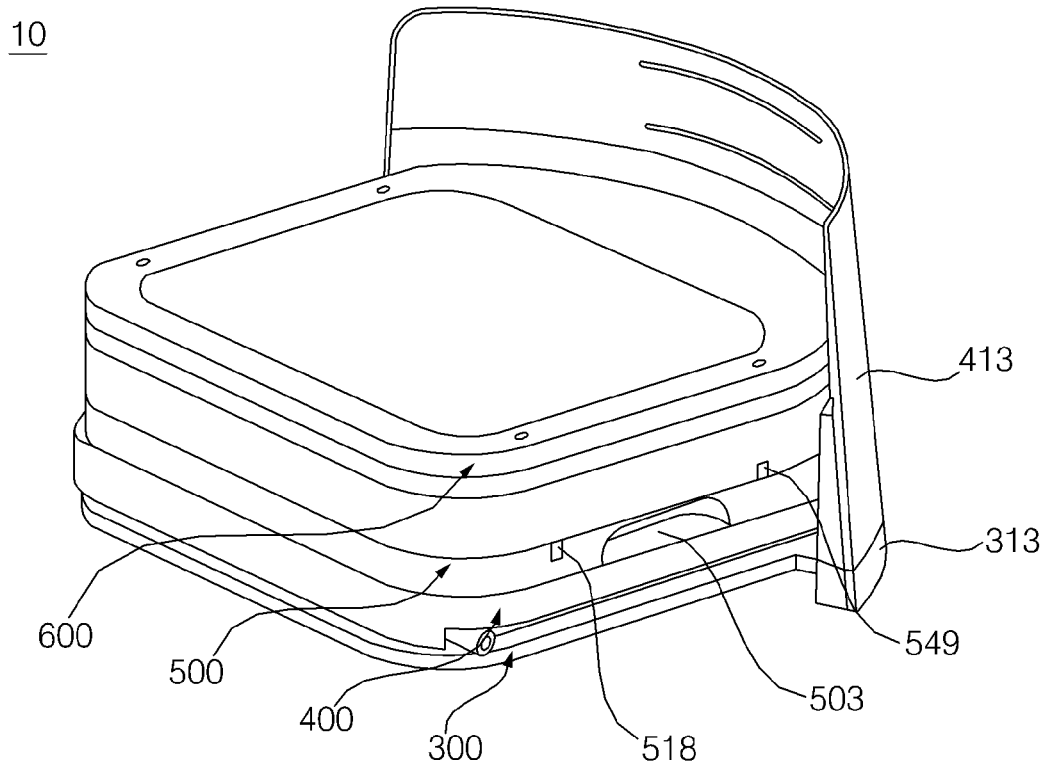
FIG. 7 is a perspective view showing the filter assembly of FIG. 6.
Figure 8:
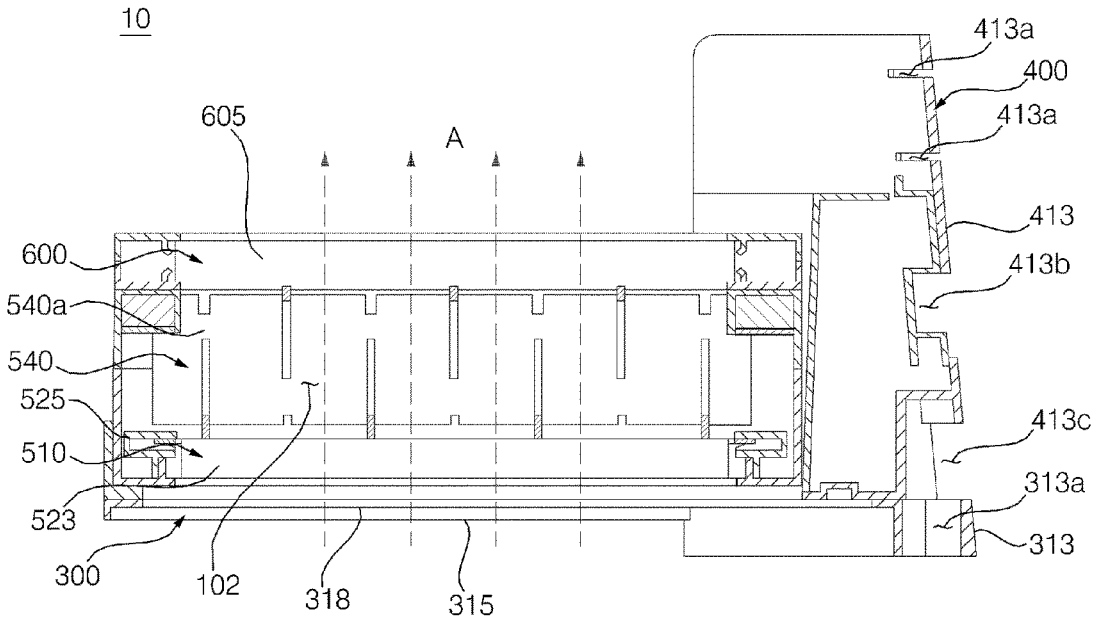
FIG. 8 is a vertical sectional view showing the filter assembly of FIG. 7.
Figure 9:
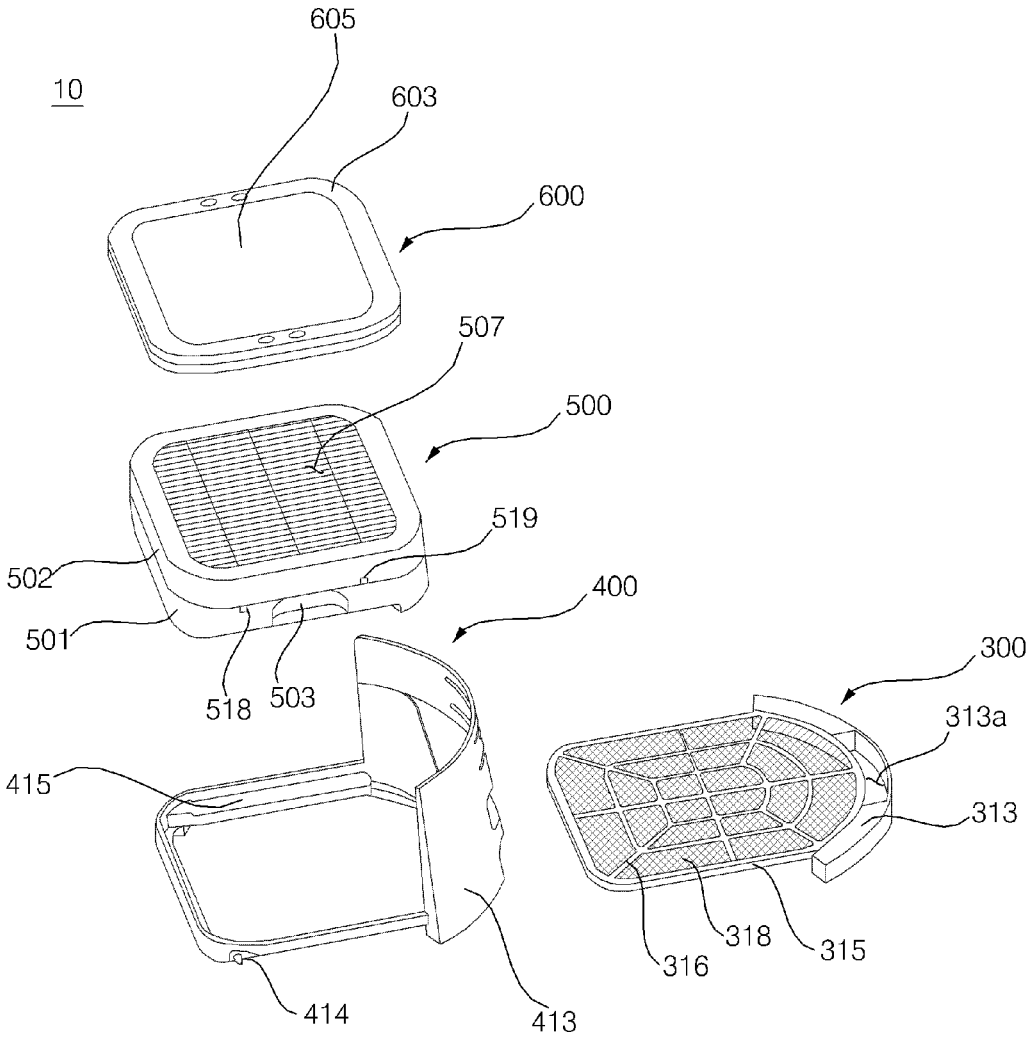
FIG. 9 is an exploded perspective view showing the filter assembly of FIG. 7.

FIG. 6 is a perspective view showing the body 130 of FIG. 1 and the filter assembly 10 separably coupled thereto. FIG. 7 is a perspective view showing the filter assembly 10 of FIG. 6. FIG. 8 is a vertical sectional view showing the filter assembly 10 of FIG. 7. FIG. 9 is an exploded perspective view showing the filter assembly 10 of FIG. 7.

Referring to FIGS. 6 and 7, the filter installation opening 133 is formed in a portion of the outer circumference of the body 130 such that the inner space and the outer space of the filter housing 140 communicate with each other through the filter installation opening 133. The filter assembly 10 is slid in the direction in which the filter assembly 10 is inserted into and withdrawn from the filter installation opening 133.

Stepped guides (not shown) may be formed on opposite sides of the inner surface of the filter housing 140 to guide the sliding of the filter assembly 10. The guides may include at least one upper surface, which provides a frictional surface for supporting the filter assembly 10. Alternatively, the guides may include at least one roller or bearing.

The left and right side surfaces (the side surfaces at which the guides are disposed) of the filter housing 140 prevent the movement of the filter assembly 10 in the leftward-rightward direction and guide the movement of the filter assembly 10 such that the filter assembly 10 can move only in the forward-rearward direction (i.e. only in the direction in which the filter assembly 10 is inserted and withdrawn).

A power terminal (not shown) for supplying power to an electric dust collector 500, a description of which will follow, and a ground terminal (not shown) for grounding the electric dust collector 500 are disposed on at least one of the left and right side surfaces of the filter housing 140. A power terminal for supplying power to an electrification unit 510, a description of which will follow, and a power terminal for supplying power to a dust collection unit 540, a description of which will follow, may be separately provided. A ground terminal for grounding the electrification unit 510 and a ground terminal for grounding the dust collection unit 540 may be separately provided.

Power-receiving terminals 518 and 548 and ground-receiving terminals 519 and 549 are provided at the left and right side surfaces of the electric dust collector 500 so as to correspond to the power terminals and the ground terminals, respectively. That is, the power-receiving terminals 518 and 548 and the ground-receiving terminals 519 and 549 are disposed such that the power terminals and the ground terminals can contact power-receiving terminals 518 and 548 and the ground-receiving terminals 519 and 549, respectively, only when the electric dust collector 500 is fully inserted into the body 130.

The power-receiving terminals 518 and 548 include an electrification unit power-receiving terminal 518 for supplying power to the electrification unit 510 and a dust collection unit power-receiving terminal 548 for supplying power to the dust collection unit 540. The ground-receiving terminals 519 and 549 include an electrification unit ground-receiving terminal 519 for grounding the electrification unit 510 and a dust collection unit ground-receiving terminal 549 for grounding the dust collection unit 540.

The electrification unit power-receiving terminal 518 and the dust collection unit power-receiving terminal 548 may be disposed in the same horizontal plane of the electric dust collector 500 so as to be spaced apart from each other diagonally. The electrification unit ground-receiving terminal 519 and the dust collection unit ground-receiving terminal 549 may be disposed in the same horizontal plane of the electric dust collector 500 so as to be spaced apart from each other diagonally.

A dust sensor 135 may be installed at the body 130.

At least a portion of the dust sensor 135 is exposed to external air. The dust sensor 135 senses the concentration of dust in the external air.

The dust sensor 135 is disposed at the outer circumference of the body 130. In this embodiment, the dust sensor 135 is disposed at the upper side of the filter installation opening 133, and is disposed so as to be visually hidden by the filter cover 413 in the state in which the filter assembly 10 is coupled to the body 130.

A depression 134, which is depressed from the outer circumference of the body 130 by a distance corresponding to the thickness of the filter cover 413, is formed in the upper part of the filter installation opening 133. The dust sensor 135 is disposed in the depression 134. The filter cover 413 is engaged with the depression 134 when coupled to the body 130.

The dust-sensing opening 413*a* is formed in the portion of the filter cover 413 corresponding to a position of the dust sensor 135 such that external air is supplied to the dust sensor 135 even in the state in which the dust sensor 135 is covered by the filter cover 413. In this embodiment, the dust-sensing opening 413*a* is formed in the shape of a slit extending in the horizontal direction. A plurality of dust-sensing openings 413*a* is arranged vertically so as to be spaced apart from each other.

The filter assembly 10 includes a mesh filter 300, an electric dust collector 500, and a photo-catalyst filter 600, which are sequentially arranged from the upstream side to the downstream side thereof. The mesh filter 300 filters foreign matter from air when the air passes through a mesh. The electric dust collector 500 electrifies dust particles in the air and collects the electrified dust particles so as to filter the air. The photo-catalyst filter 600, which is formed by applying a photo-catalyst having a deodorization function to a porous base, physically/chemically removes smell components from air. In this embodiment, the mesh filter 300 is disposed at the lowermost part of the filter assembly 10, the electric dust collector 500 is disposed at the upper side of the mesh filter 300, and the photo-catalyst filter 600 is disposed at the uppermost part of the filter assembly 10.

The filter assembly 10 includes a drawer 400 for supporting at least a portion of the filter assembly 10 while sliding along the guides of the filter housing 140. The filter cover 413 is disposed at the front of the drawer 400.

The filter cover 413 is provided at the middle of the front surface of thereof with a filter cover grip 413*b*, which is depressed to pull the drawer 400. The filter cover grip 413*b* is depressed rearward in the front surface of the filter cover 413. The filter cover grip 413*b* is formed as the result of the lower surface, which is one of the left, right, upper, and lower surfaces of the filter cover 413 depressed and exposed rearward, being depressed downward.

In this embodiment, the electric dust collector 500 supports the photo-catalyst filter 600, and the drawer 400 supports the electric dust collector 500. The mesh filter 300 is disposed at the lower side of the drawer 400 so as to be inserted or withdrawn independent of the drawer 400.

The mesh filter 300 includes a mesh filter cover 313 defining a surface that is continuously connected to the front surface of the filter cover 413 in the state in which the mesh filter 300, the body 130, and the filter cover 413 are coupled to one another. The mesh filter cover 313 has a mesh filter cover grip 313*a*, which is depressed downward in the upper surface thereof, which defines the thickness of the mesh filter cover 313.

The filter cover 413 has a grip exposure part 413*c*, which is depressed in at least a portion of the lower end thereof such that the mesh filter cover grip 313*a* is exposed to the outside in the state in which the mesh filter 300, the body 130, and the filter cover 413 are coupled to one another. The front surface and the lower surface of the grip exposure part 413*c* are open. The grip exposure part 413*c* may be depressed rearward from the front surface of the filter cover 413 to the rear end of the mesh filter cover grip 313*a*. The user may put his/her hand in the grip exposure part 413*c* so as to hold the mesh filter cover grip 313*a*.

The mesh filter 300 includes a mesh frame 315 disposed along the circumference of the filtration channel 102 in the horizontal plane at the rear of the mesh filter cover 313 and an auxiliary mesh frame 316 disposed inside the mesh frame 315 for dividing the horizontal section of the filtration channel 102. The auxiliary mesh frame 316 divides the horizontal section of the filtration channel 102 into a plurality of parts.

The mesh filter 300 includes a mesh 318 for filtering and collecting foreign matter from air passing therethrough. The mesh 318 is supported by the mesh frame 315 and the auxiliary mesh frame 316. The mesh 318 is disposed in the same plane as the mesh frame 315 and the auxiliary mesh frame 316. The mesh filter 300 may be separated from the body 130 and may be washed to remove the foreign matter, collected by the mesh 318, from the mesh 318.

Sliders 414 configured to be supported by the guides and slidably guided are provided at the left and right sides of the drawer 400. The sliders 414 may include rails or rollers.

The drawer 400 includes electric dust collector location parts 415 defining an upper surface for supporting the electric dust collector 500. The electric dust collector location parts 415 may be formed at the left and right side surfaces of the drawer 400. Portions of the lower surface of the electric dust collector 500 contact the upper surfaces of the electric dust collector location parts 415, whereby the electric dust collector 500 is supported.

The electric dust collector 500 includes a case 501 and 502 defining the external appearance thereof. An electric dust collector grip 503 for enabling the user to lift the electric dust collector 500 such that the electric dust collector 500 is separated from the drawer 400 is formed in the case 501 and 502. The electric dust collector grip 503 may be formed in each of the left and right sides of the case 501 and 502. The electric dust collector grips 503 may be depressed in the case 501 and 502.

The electric dust collector 500 includes an electrification unit 510 for electrifying dust particles in the air and a dust collection unit 540 for collecting the dust particles electrified by the electrification unit 510. The electrification unit 510 is disposed at the lower side, and the dust collection unit 540 is disposed at the upper side.

The case 501 and 502 may include an electrification unit case 501 for receiving the electrification unit 510 and a dust collection unit case 502 for receiving the dust collection unit 540. The electrification unit case 501 is disposed at the lower side, and the dust collection unit case 502 is disposed at the upper side. The case 501 and 502 is formed such that the space for receiving the electrification unit 510 and the space for receiving the dust collection unit 540 communicate with each other.

The electrification unit case 501 is provided in the lower surface thereof with an electrification unit case inlet port 506, through which air is introduced into the electric dust collector 500. The dust collection unit case 502 is provided in the upper surface thereof with a dust collection unit case outlet port 507, through which air is discharged from the electric dust collector 500.

The photo-catalyst filter 600 includes a photo-catalyst filter frame 603 disposed on the circumference of the filtration channel 102 and a photo-catalyst operation unit 605 supported by the photo-catalyst filter frame 603. The photo-catalyst operation unit 605 may be manufactured by applying a well-known photo-catalyst having a deodorization function to a base member having an aperture, which forms a portion of the filtration channel 102. Alternatively, the photo-catalyst operation unit 355 may be manufactured by forming an aperture in a member having a photo-catalyst property.

In this embodiment, the photo-catalyst includes activated carbon. Smell particles may be collected by the photo-catalyst operation unit 605 due to physical adhesive force of the activated carbon. The smell particles may be collected by the photo-catalyst operation unit 605 via chemical coupling using the activated carbon or other photo-catalysts. The photo-catalyst filter 600 may be separated from the body 130 and the filter assembly 10 and may be exposed to the sun such that the smell particles are removed from the photo-catalyst operation unit 605.

Air flows in the direction denoted by reference symbol A. Specifically, air introduced into the air conditioner through the suction channel 101 flows to the filtration channel 102. The air introduced into the filtration channel 102 passes through the mesh 318 and is introduced into the electrification unit case 501 through the electrification unit case inlet port 506. The air, introduced into the electrification unit case 501, sequentially passes through the electrification unit 510 and the dust collection unit 540, and flows upward through the dust collection unit case outlet port 507. Subsequently, the air passes through the photo-catalyst operation unit 605.

In other embodiments, the disposition of the components may be changed, and the components may be arranged horizontally. In this case, settings are performed such that air flows from the electrification unit 510 to the dust collection unit 540.

Figure 10:
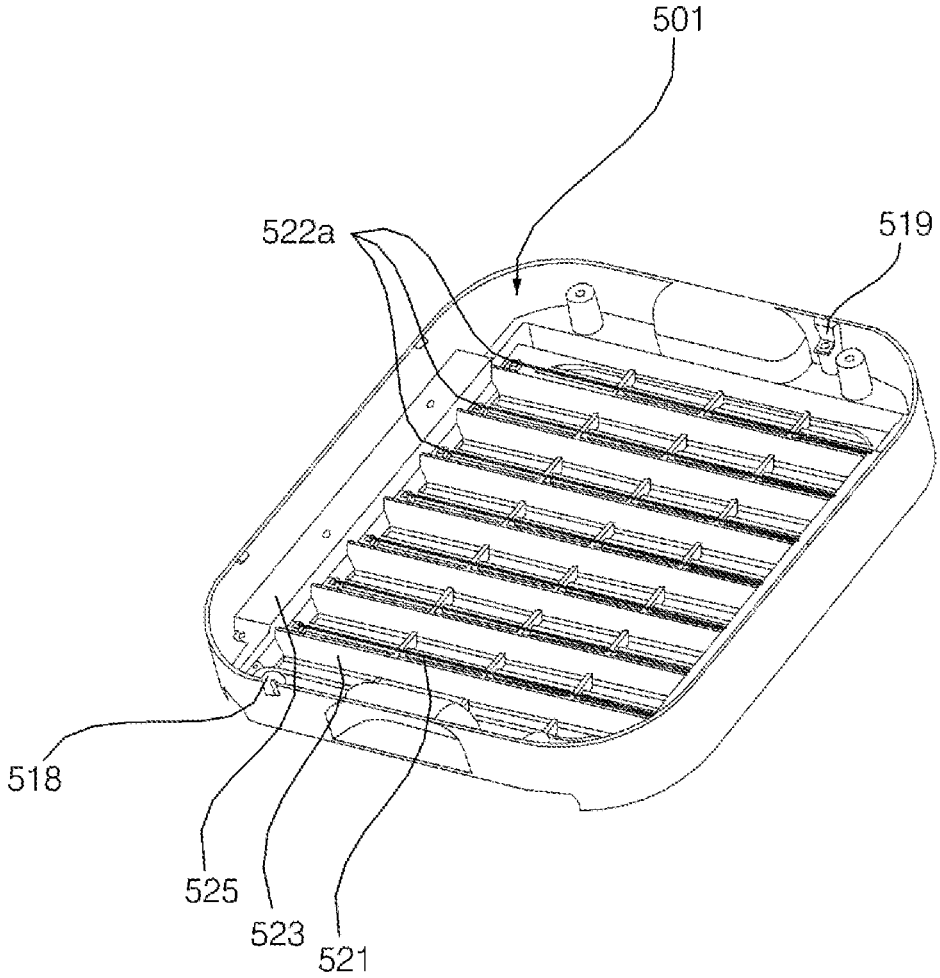
FIG. 10 is a perspective view showing an electrification unit of an electric dust collector of FIG. 9.
Figure 11:
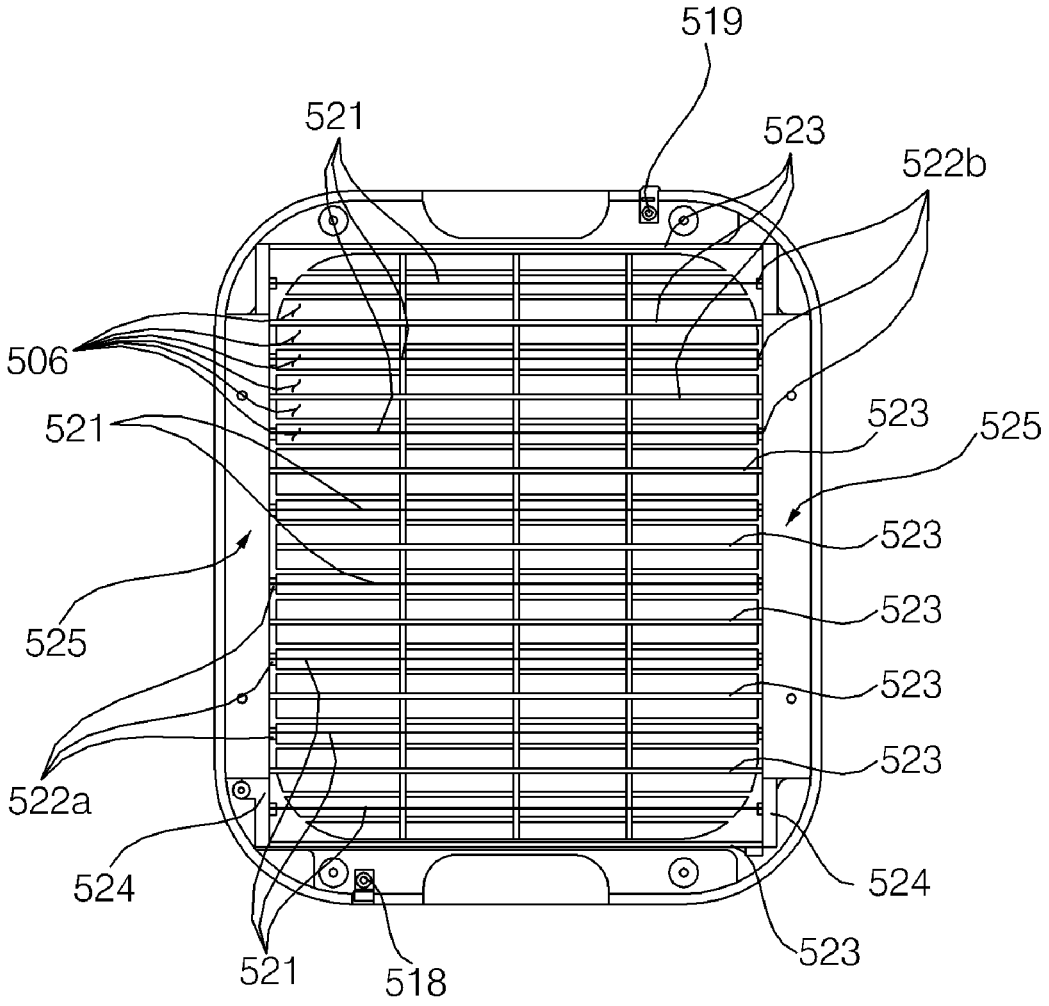
FIG. 11 is an elevation view showing the interior of the electrification unit of FIG. 10 when viewed from above.

FIG. 10 is a perspective view showing the electrification unit 510 of the electric dust collector 500 of FIG. 9, and FIG. 11 is an elevation view showing the interior of the electrification unit 510 of FIG. 10 when viewed from above.

The electrification unit 510 according to this embodiment will be described with reference to FIGS. 10 and 11. The electrification unit 510 includes a wire discharge electrode 521, to which high voltage is applied, and an opposite electrode plate 523 spaced apart from the wire discharge electrode 521. High voltage is applied to the wire discharge electrode 521 such that discharge can occur between the wire discharge electrode 521 and the opposite electrode plate 523.

When voltage is applied to the wire discharge electrode 521, corona discharge occurs between the wire discharge electrode 521 and the opposite electrode plate 523. As a result, molecules in the air may be ionized, whereby negative ions, such as OH− or O−, or positive ions, such as H+, may be generated. The generated ions electrify dust particles in the air. The negative ions may provide electrons to the dust particles such that the dust particles are electrified and act as a negative electrode. The positive ions may remove electrons from the dust particles such that the dust particles are electrified and act as a positive electrode.

A plurality of opposite electrode plates 523 may be disposed. The opposite electrode plates 523 may be spaced apart from each other so as to face each other in the state in which the wire discharge electrode 521 is disposed between the respective opposite electrode plates 523.

The opposite ends of the opposite electrode plates 523 may be connected to each other via the electrode plate connection parts 524. The electrode plate connection parts 524 are disposed in the horizontal plane, and the opposite electrode plates 523 are disposed in the plane perpendicular to the electrode plate connection parts 524.

The electrode plate connection parts 524 and the opposite electrode plates 523 may be integrally formed by incising the middle part of a metal sheet and bending the incised middle part by 90 degrees. Specifically, the electrode plate connection parts 524 and the opposite electrode plates 523 may be integrally formed as follows. The middle part of a metal sheet is incised to a length equal to that of the long side of each of the opposite electrode plates 523, excluding the opposite ends of the metal sheet, which will serve as the electrode plate connection parts 524. The opposite ends of the middle part of the metal sheet, incised to the length equal to that of the long side of each of the opposite electrode plates 523, are incised to a length equal to that of the short side of each of the opposite electrode plates 523 so as to be perpendicular to the incised middle part. The part of the metal sheet incised in a bracket shape (i.e. the middle part incised to the length equal to that of the long side of each of the opposite electrode plates 523 and the opposite ends of the middle part incised to the length equal to that of the short side of each of the opposite electrode plates 523 so as to be perpendicular to the incised middle part) is bent by 90 degrees. The bent part becomes a corresponding one of the opposite electrode plates 523.

A plurality of wire discharge electrodes 521 may be disposed. The wire discharge electrodes 521 may be spaced apart from each other so as to be parallel to each other. The opposite electrode plates 523 may be disposed between the respective wire discharge electrodes 521 so as to be parallel to the wire discharge electrodes 521.

The wire discharge electrodes 521 may be connected to each other in series. That is, the wire discharge electrodes 521 may be constituted by a single wire member. In this embodiment, a single wire member extends from one one-side wire support part 522*a* to one opposite-side wire support part 522*b* so as to constitute a wire discharge electrode 521. The wire member extends from the one opposite-side wire support part 522*b* to another opposite-side wire support part 522*b* adjacent to the one opposite-side wire support part 522*b* so as to constitute a wire series connection part (not shown). The wire member extends from the another opposite-side wire support part 522*b* to another one-side wire support part 522*a* adjacent to the one one-side wire support part 522*a* so as to constitute another wire discharge electrode 521. In this way, the wire discharge electrodes 521 are connected to the wire series connection parts via the wire support parts 522*a* and 522*b*, which are disposed at opposite sides so as to be spaced apart from each other by a predetermined distance.

Each of the wire support parts 522 includes a vertical member extending in the air flow direction. The wire member may be bent at the vertical member while being supported by the vertical member.

In this embodiment, a plurality of wire discharge electrodes 521 and a plurality of opposite electrode plates 523 are alternately arranged so as to be spaced apart from each other in the direction perpendicular to the air flow direction A. The wire discharge electrodes 521 and the opposite electrode plates 523 are disposed at the downstream side of the electrification unit case inlet port 506.

The electrode plate connection parts 524 are disposed at the opposite ends of the opposite electrode plates 523 so as to extend in the direction perpendicular to the opposite electrode plates 523. The wire series connection parts are disposed at the opposite ends of the wire discharge electrodes 521 so as to extend in the direction perpendicular to the wire discharge electrodes 521.

The wire discharge electrodes 521 may be disposed between the respective opposite electrode plates 523 so as to be adjacent to the upstream sides thereof. The wire series connection parts may be disposed in the same plane as the wire discharge electrodes 521. The electrode plate connection parts 524 may be disposed in the plane at the downstream sides of the opposite electrode plates 523 such that the wire series connection parts are spaced further apart from the electrode plate connection parts 524. The reason for this is that it is necessary to reduce the possibility of sparks occurring between the wire series connection parts and the electrode plate connection parts 524, since high voltage is also applied to the wire series connection parts and the electrode plate connection parts 524 are also made of a metal material and are electrically connected to the opposite film plates 523.

The wire discharge electrodes 521 and the opposite electrode plates 523 are fixed to the electrification unit case 501. The opposite ends of the portion of the wire member corresponding to each of the wire discharge electrodes 521 are fixed to the electrification unit case 501. High voltage is applied to the portion of the wire member via the fixed ends thereof.

The electrification unit 510 includes a spark prevention part 525 fixed to the electrification unit case 501 for supporting the opposite electrode plates 523. The spark prevention part 525 fixes the electrode plate connection parts 524.

The spark prevention part 525 is disposed at each end of each of the opposite electrode plates 523. The spark prevention part 525 includes a shielding member (not shown) interposed between each of the electrode plate connection parts 524, which are disposed so as to be vertically spaced apart from each other, and a corresponding one of the wire series connection parts. The shielding member may be made of an insulative material. The shielding member reduces the likelihood of sparks occurring between each of the wire series connection parts and a corresponding one of the electrode plate connection parts 524.

The spark prevention part 525 is provided with a recess, into which each of the electrode plate connection parts 524 is inserted. The recess, into which each of the electrode plate connection parts 524 is inserted, is depressed in the longitudinal direction of the opposite electrode plates 523. The member having the recess, into which each of the electrode plate connection parts 524 is inserted, surrounds the upper surface and the lower surface of each of the electrode plate connection parts 524. The member for surrounding the lower surface of each of the electrode plate connection parts 524 may be constituted by the shielding member.

An electrification unit according to another embodiment includes at least one ion generator (not shown) for generating ions. A plurality of ion generators may be arranged at intervals in the direction perpendicular to the direction A in which air flows. The ion generators may electrify dust particles in the air. Each ion generator includes a carbon fiber electrode (not shown) for performing corona discharge. The carbon fiber electrode may be formed in the shape of a brush. The carbon fiber electrode may be formed by binding a plurality of micro carbon fibers into a brush bundle.

Figure 12:
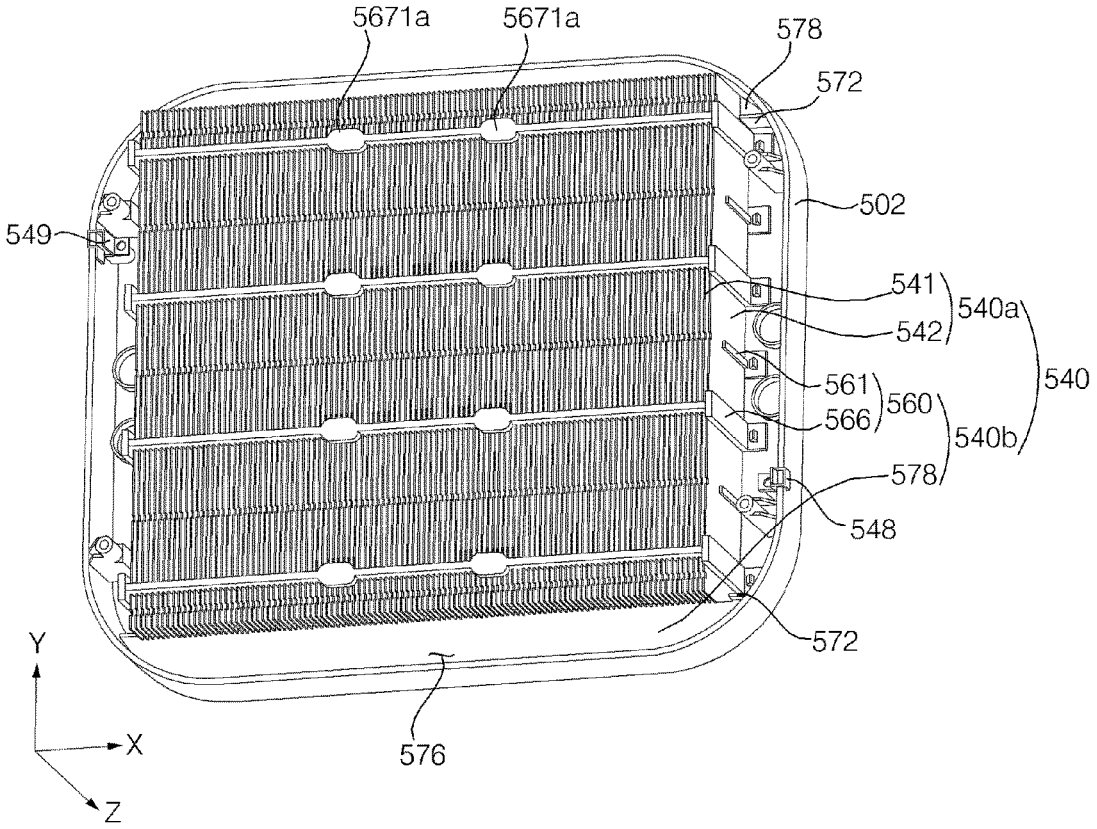
FIG. 12 is a perspective view showing a dust collection unit of the electric dust collector of FIG. 9.
Figure 13:
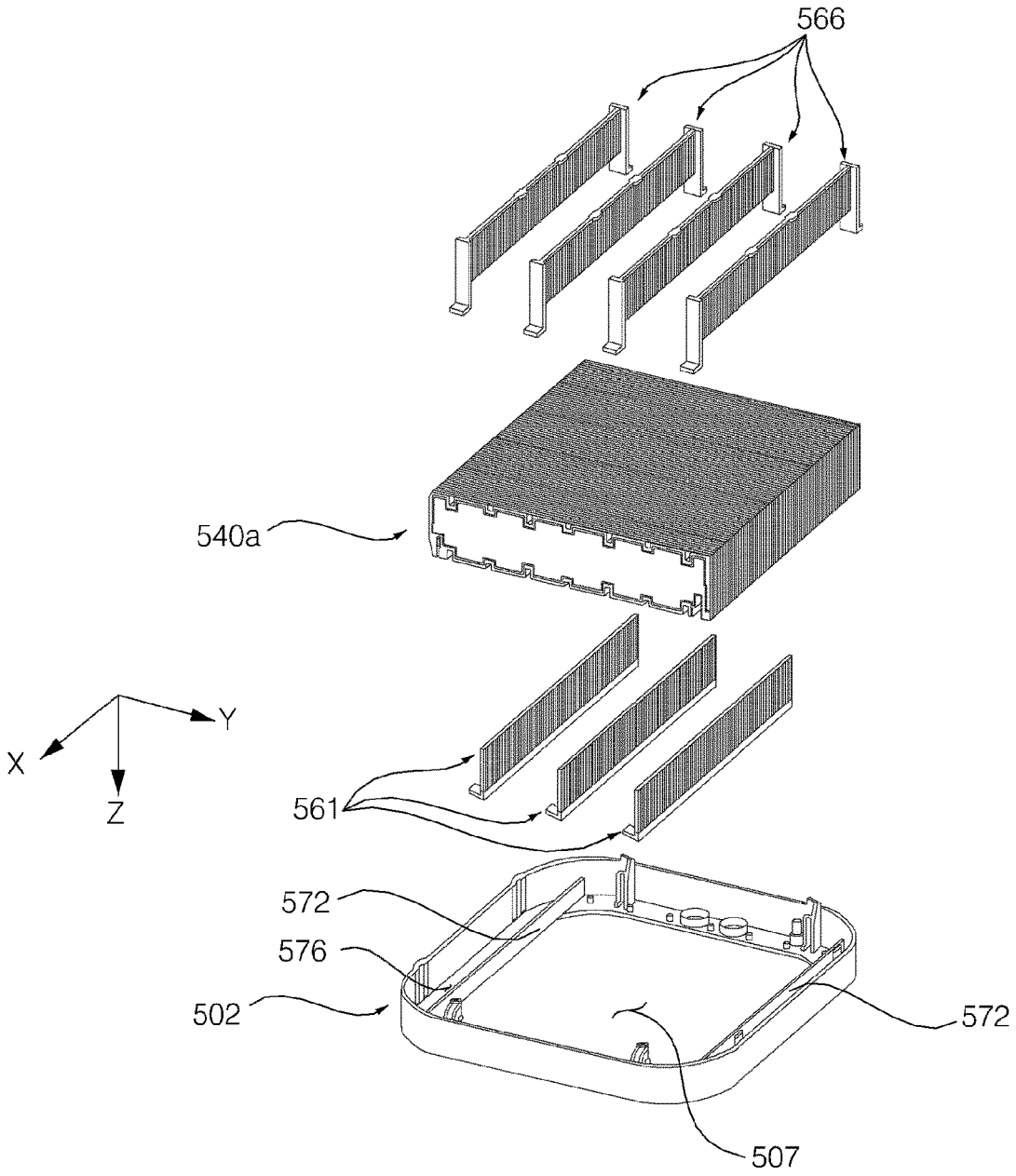
FIG. 13 is an exploded perspective view showing a dust collection unit case, a base gap maintenance part, a plurality of films, and a roof gap maintenance part of FIG. 12.
Figure 14:
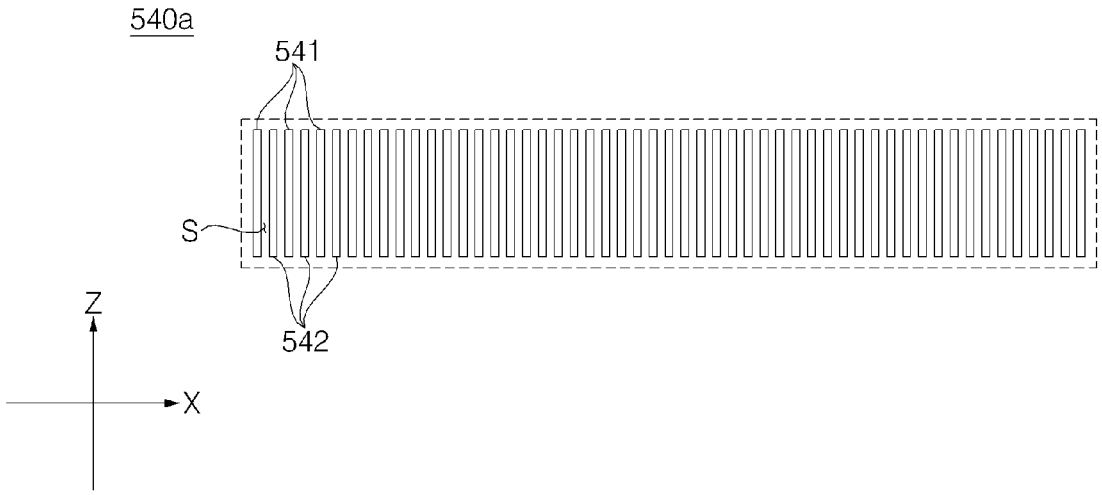
FIG. 14 is a sectional conceptual view showing the sections of the films of FIG. 13 in the direction in which the films are arranged.
Figure 15:
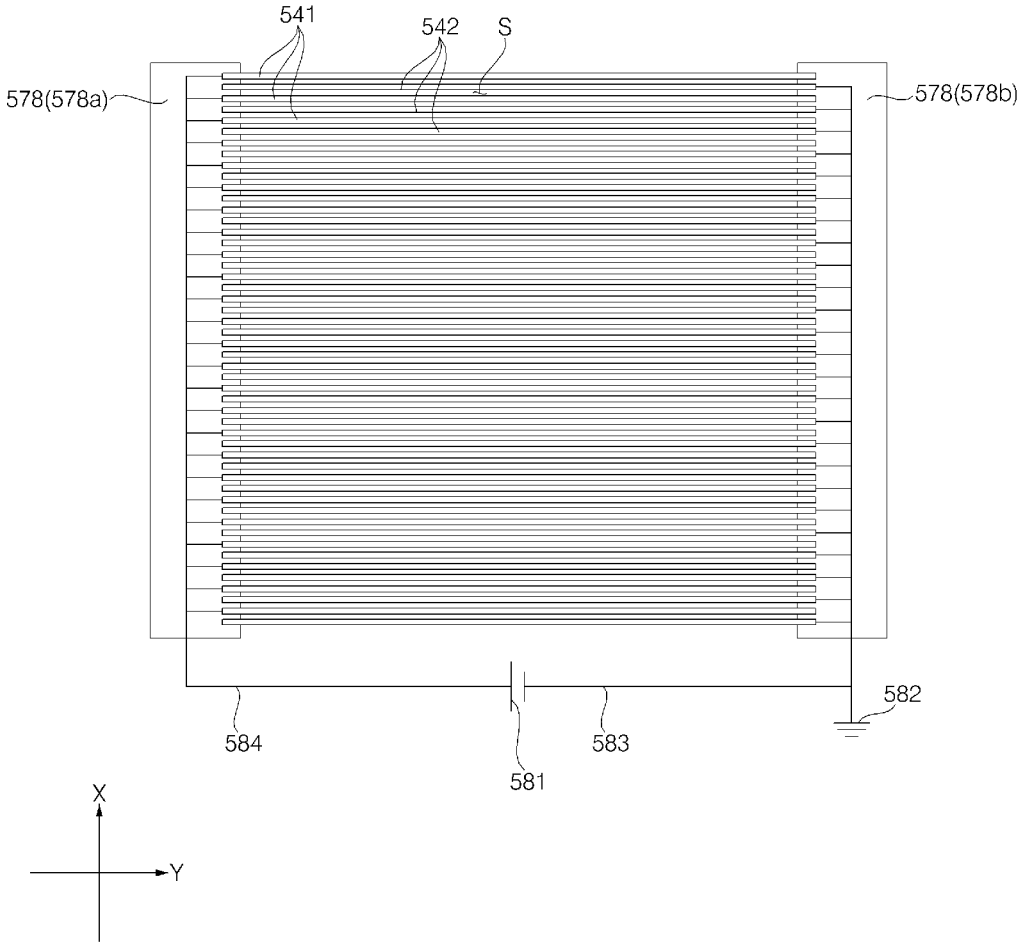
FIG. 15 is a plan conceptual view showing the films of FIG. 13 when viewed from above while also showing a circuit.
Figure 16:
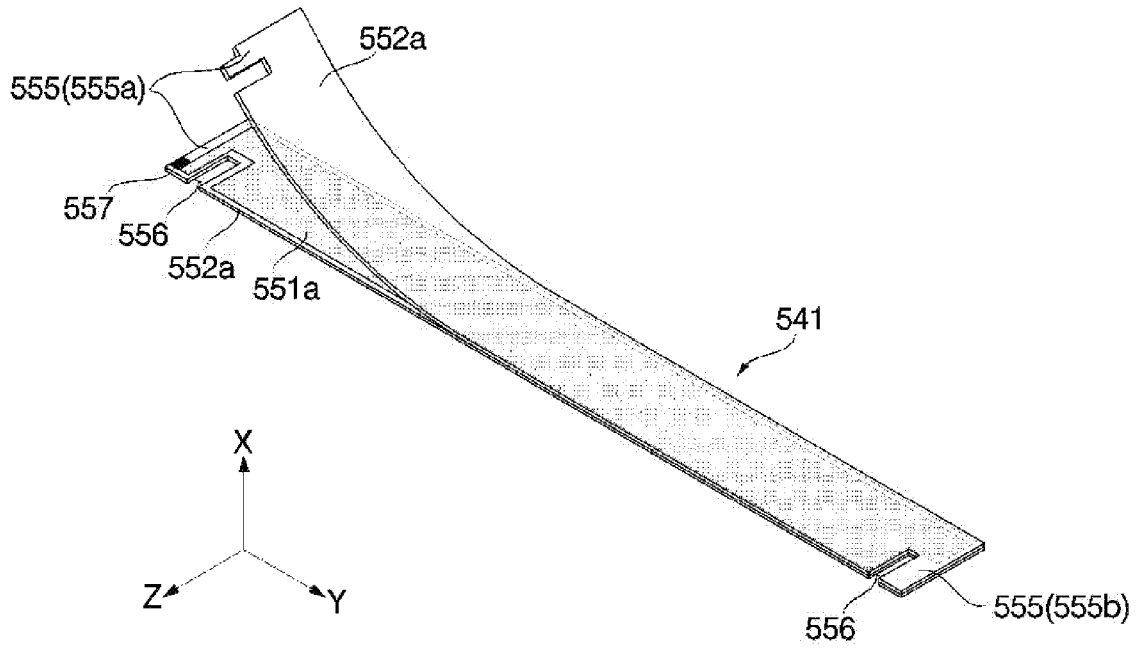
FIG. 16 is a perspective view showing the structure of a first film of FIG. 12.
Figure 17:
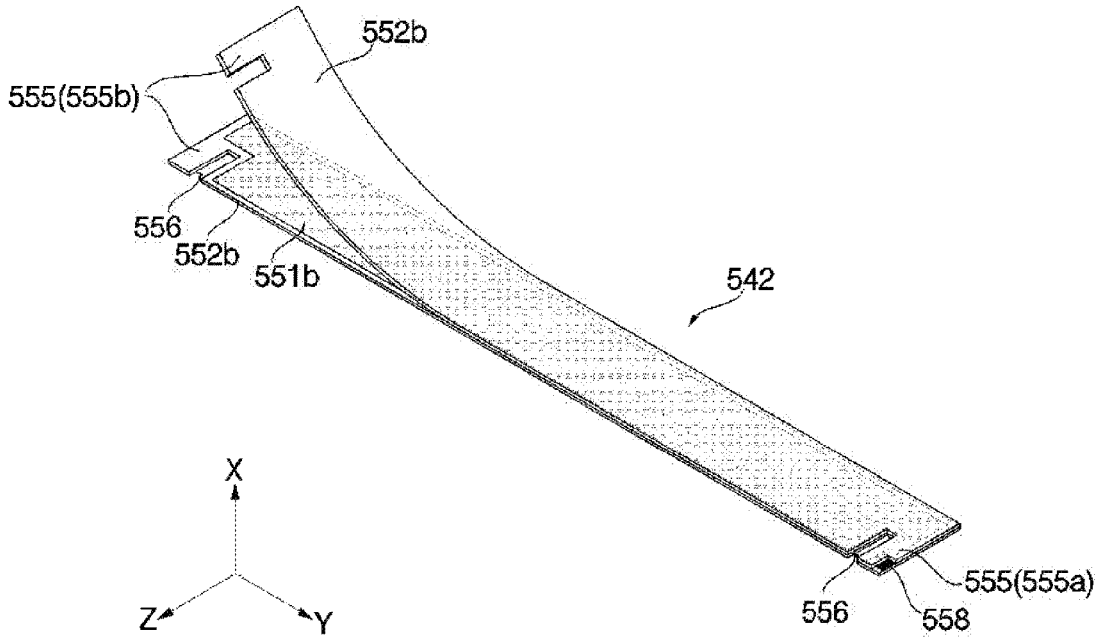
FIG. 17 is a perspective view showing the structure of a second film of FIG. 12.

FIG. 12 is a perspective view showing the dust collection unit 540 of the electric dust collector 500 of FIG. 9. FIG. 13 is an exploded perspective view showing the dust collection unit case 502, a base gap maintenance part 561, a plurality of films 540*a*, and a roof gap maintenance part 566 of FIG. 12. FIG. 14 is a sectional conceptual view showing the sections of the films 540*a* of FIG. 13 in the direction in which the films 540*a* are arranged, and FIG. 15 is a plan conceptual view showing the films 540*a* of FIG. 13 when viewed from above while also showing a circuit. FIG. 16 is a perspective view showing the structure of a first film 541 of FIG. 12, and FIG. 17 is a perspective view showing the structure of a second film 542 of FIG. 12.

The dust collection unit 540 includes a plurality of films 540*a* for generating an electric field and a fixing part 540*b* for fixing the films 540*a* in the dust collection unit case 502. Each film 540*a* may be formed by applying insulation layers to opposite surfaces of a conductive layer.

The films 540*a* are arranged to constitute a film group. The fixing part 540*b* fixes the films 540*a* in the dust collection unit case 502.

The films 540*a* may face each other such that one or more gaps S are formed between the respective films. Two films 540*a* are arranged to form a gap therebetween. Three or more films 540*a* are arranged to form gaps therebetween. Each of the films 540*a* may be formed in the shape of a band that is longer in the longitudinal direction Y than in the lateral direction Z. The films 540*a* may be arranged so as to face each other such that gaps S are formed between the respective films. The films 540*a* may be arranged side by side.

The fixing part 540*b* includes gap maintenance parts 561 and 566 disposed on at least one of the lateral opposite sides of the films 540*a* for maintaining the gaps S.

The gap maintenance parts 561 and 566 are fixed in the case 501 and 502. In this embodiment, the gap maintenance parts 561 and 566 are fixed only to the dust collection unit case 502. The gap maintenance parts 561 and 566 may also support the films 540*a*.

The gap maintenance parts may include roof gap maintenance parts 566, which are disposed at one of the opposite sides of the films 540*a* in the lateral direction Z that is distant from the inner surface of the dust collection unit case 502. The gap maintenance parts 561 and 566 may include base gap maintenance parts 561, disposed at one side of the films 540*a* in the lateral direction Z, and roof gap maintenance parts 566, disposed at the other side of the films 540*a* in the lateral direction Z.

In this embodiment, on the assumption that air flows to one side of the films in the lateral direction Z, the dust collection unit case outlet port 507, through which air passes, is formed in one side of the dust collection unit case 502, and the films 540*a* are arranged such that the one side of the films in the lateral direction Z faces the outlet port 507.

The fixing part 540*b* includes a molding part 578 formed by hardening predetermined paste in the state in which a portion of each of the films 540*a* is immersed in the paste. The molding part 578 fixes the films 540*a*.

The films 540*a* may include a plurality of first films 541, to conductive layers 551*a* of which relatively high potential is applied, and a plurality of second films 542, to conductive layers 551*a* of which relatively low potential is applied. Each of the films 540*a* is formed by applying insulative layers to opposite surfaces of the conductive layer.

The first films 541 and the second films 542 are alternately arranged. The first films 541 and the second films 542 are alternately arranged so as to face each other such that gaps S are formed therebetween.

The films 540*a* are arranged such that the lateral direction Z of the films is the upward-downward direction. However, the present invention is not limited thereto. The films 540*a* may be arranged side by side so as to be aligned in the longitudinal direction Y. The films 540*a* are arranged such that gaps S are formed between the films in the direction X, which is perpendicular to both the lateral direction Z and the longitudinal direction Y. In this embodiment, about 20 to 30 first films and about 20 to 30 second films are alternately arranged.

The dust collection unit 540 includes a voltage source 581 for generating high potential, a second conducting wire 583 for connecting the conductive layers 551*b* of the second films 542 to the negative pole of the voltage source 581, and a first conducting wire 584 for connecting the conductive layers 551*a* of the first films 541 to the positive pole of the voltage source 581. The second conducting wire 583 may be connected to a ground 582.

The conductive layers 551*a* of the first films 541 may be connected to the first conducting wire 584 such that relatively high potential is applied to the conductive layers 551*a* of the first films 541. The conductive layers 551*b* of the second films 542 may be connected to the second conducting wire 583 such that relatively low potential is applied to the conductive layers 551*b* of the second films 542. The voltage source 581 may be configured such that a voltage of about 7 to 9 kV is applied between the conductive layers 551*a* of the first films 541 and the conductive layers 551*b* of the second films 542.

Referring to FIGS. 16 and 17, each of the first films 541 and the second films 542 is formed in the shape of a band. The length of the first film 541 and the second film 542 may be about 200 to 250 mm. The first film 541 and the second film 542 may be formed in the shape of a flat plate. At least a portion of the first film 541 and the second film 542 may be curved in the direction X.

The conductive layers of the films 540*a* may be made of a carbon material. The conductive layers may have a thickness of 10 to 100 um. The conductive layer 551*a* of each first film 541 constitutes a high-potential electrode, and the conductive layer 551*b* of each second film 542 constitutes a low-potential electrode.

A pair of insulative layers covers a conductive layer, excluding a portion of the conductive layer. The insulative layers may be made of a material, such as PP, PET, PEN, or PU, containing a nano-filler, such as $TiO_2$, $Al_2O_3$, or $SiO_2$. The insulative layers 552*a* and 552*b* may have a thickness of 100 to 1500 um.

The conductive layer may be patterned on one surface of one of the insulative layers by carbon screen printing, and the other of the insulative layers may be attached to the one of the insulative layers while covering the carbon pattern excluding a portion of the carbon pattern.

The films 540*a* include exposed parts 557 and 557, through which portions of the conductive layers are exposed. That is, portions of the conductive layers of the films 540*a* are exposed to the outside, and the remainders of the conductive layers of the films 540*a* are covered by the insulative layers.

The paste may be conductive paste having electrical conductivity. The molding part 578 may be an electrode connection part 578 having electrical conductivity. In this case, the molding part 578 not only fixes the films 540*a* but also functions as an electrical line for supplying power to the conductive layers of the films 540*a*. Hereinafter, the molding part 578, which has the two functions described above, will be referred to as an electrode connection part 578.

The electrode connection part 578 fixes the films 540*a* as the result of hardening the paste in the state in which the exposed parts 557 and 558 are immersed in the conductive paste. The electrode connection part 578 is connected to the voltage source 581 to apply voltage to the conductive layers of the films 540*a*.

The electrode connection part 578 includes a first electrode connection part 578*a* constituting the portion of the first conducting wire 584 contacting the films 540*a* and a second electrode connection part 578*b* constituting the portion of the second conducting wire 583 contacting the films 540*a*.

The exposed part 557 is formed at one end of each of the first films 541 in the longitudinal direction Y, and the exposed part 558 is formed at the other end of each of the second films 542 in the longitudinal direction Y. The first electrode connection part 578*a* is formed at one end of each of the first films 541 in the longitudinal direction Y so as to extend in the direction X in which the films are arranged, and the second electrode connection part 578*b* is formed at the other end of each of the second films 542 in the longitudinal direction Y so as to extend in the direction X in which the films are arranged.

The exposed part 557 of the conductive layer 551*a* of each of the first films 541, which is not covered by the insulative layer 552*a*, constitutes a high-potential connection part 557. The high-potential connection part 557 contacts the first conducting wire 584. That is, the high-potential connection part 557 contacts the first electrode connection part 578*a*, which constitutes a portion of the first conducting wire 584. High potential is applied to the conductive layer 551*a* of each of the first films 541 via the high-potential connection part 557.

The exposed part 558 of the conductive layer 551*b* of each of the second films 542, which is not covered by the insulative layer 552*b*, constitutes a low-potential connection part 558. The low-potential connection part 558 contacts the second conducting wire 583. That is, the low-potential connection part 558 contacts the second electrode connection part 578*b*, which constitutes a portion of the second conducting wire 583. Low potential is applied to the conductive layer 551*b* of each of the second films 542 via the low-potential connection part 558.

When relatively high potential is applied to the conductive layer 551*a* of each first film 541 and relatively low potential is applied to the conductive layer 551*b* of each second film 542, an electric field is generated between the conductive layers 551*a* and 551*b*. Dust particles electrified by the electrification unit 510 receive electric force in the electric field depending upon the electrified polarity thereof. As a result, the dust particles stick to a corresponding one of the insulative layers 552*a* of the first film 541 or a corresponding one of the insulative layers 552*b* of the second film 542.

Each film 540*a* includes a catching hook 555 extending from at least one end thereof in the longitudinal direction Y and bent in the lateral direction Z.

In this embodiment, each film 540*a* includes catching hooks 555 extending from opposite ends thereof in the longitudinal direction Y and bent in the lateral direction Z. The catching hooks 555 may be formed at opposite ends of each of the first films 541 and the second films 542 in the longitudinal direction Y.

The exposed parts 557 and 558 are formed at the catching hooks 555. The catching hooks 555 include a catching hook 555*a*, at which the conductive layer is exposed, and a catching hook 555*b*, at which the conductive layer is not exposed. The exposed part 557 of each first film 541 is formed at the catching hook 555*a* disposed at one end of the first film 541 in the longitudinal direction Y, and the exposed part 558 of each second film 542 is formed at the catching hook 555*a* disposed at the other end of the second film 542 in the longitudinal direction Y.

Each of the first films 541 is configured such that the conductive layer 551*a* is exposed only at the catching hook 555*a* formed at one end thereof. Each of the second films 542 is configured such that the conductive layer 551*b* is exposed only at the catching hook 555*a* formed at the other end thereof. That is, the high-potential connection part 557 provided at each of the first films 541 is formed only at the catching hook 555*a* formed at one end thereof, and the low-potential connection part 558 provided at each of the second films 542 is formed only at the catching hook 555*a* formed at the other end thereof.

Each of the films 540*a* has a catching recess 556 formed in at least one end thereof in the longitudinal direction Y so as to be depressed in the lateral direction Z. In this embodiment, the catching recess 556 is formed in each end of each of the films 540*a* in the longitudinal direction Y.

One surface of the catching hook 555 may define one surface of the catching recess 556. The catching recess 556 may be formed in the shape of a slit that is open at one side thereof.

The fixing part 540*b* includes holding ribs 572, which are coupled to the dust collection unit case 502 and are inserted into the respective catching recesses 556. The holding ribs 572 are engaged into the catching recess 556. The holding ribs 572 protrude from the dust collection unit case 502 toward the catching recess 556. A detailed description of the holding ribs 572 will follow.

Figure 18:
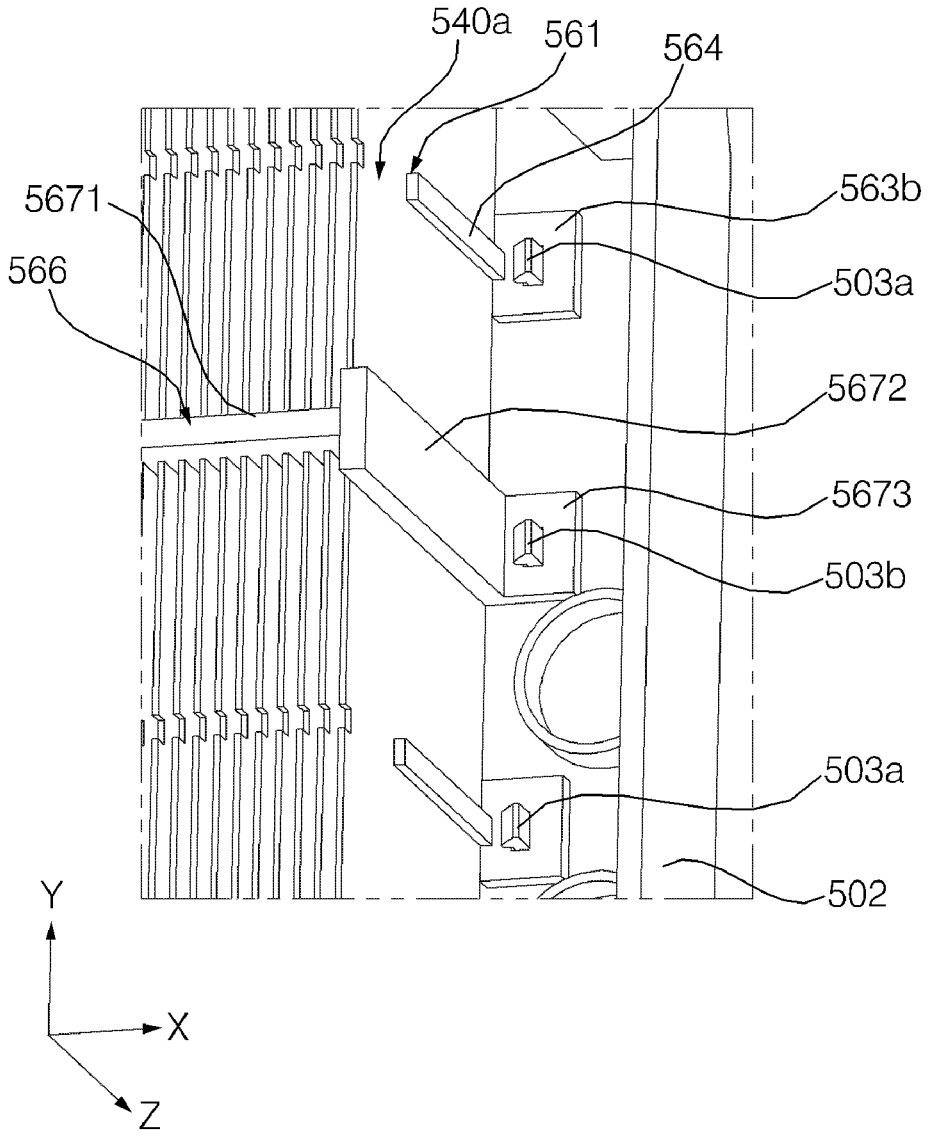
FIG. 18 is an enlarged perspective view showing the structure in which the base gap maintenance part and the roof gap maintenance part of FIG. 12 are coupled to the films and the dust collection unit case.
Figure 19:
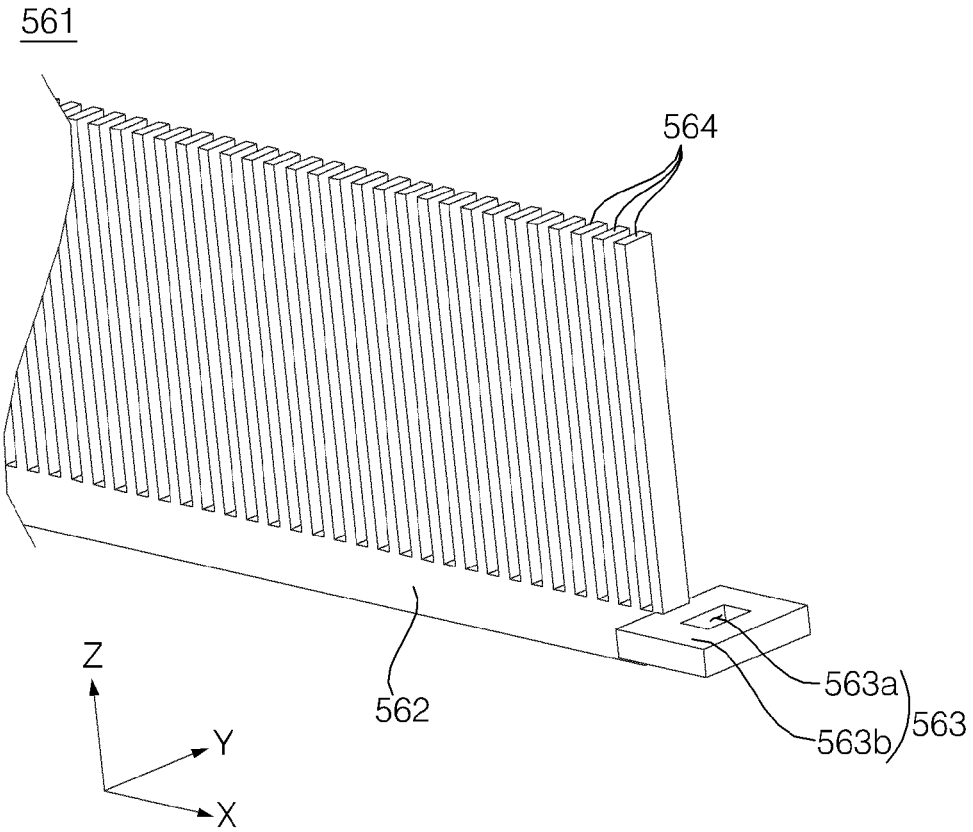
FIG. 19 is a partially enlarged perspective view showing the base gap maintenance part of FIG. 18.
Figure 20:
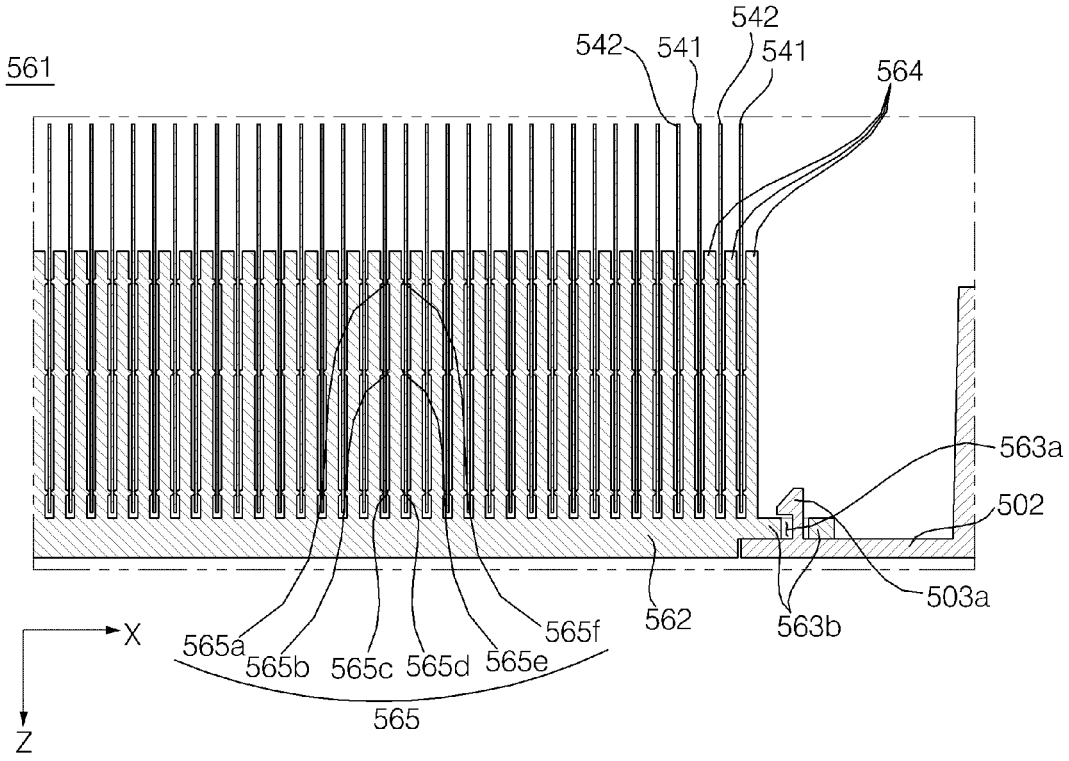
FIG. 20 is a partial sectional view showing the base gap maintenance part of FIG. 18 when cut in the direction in which the films are arranged.
Figure 21:
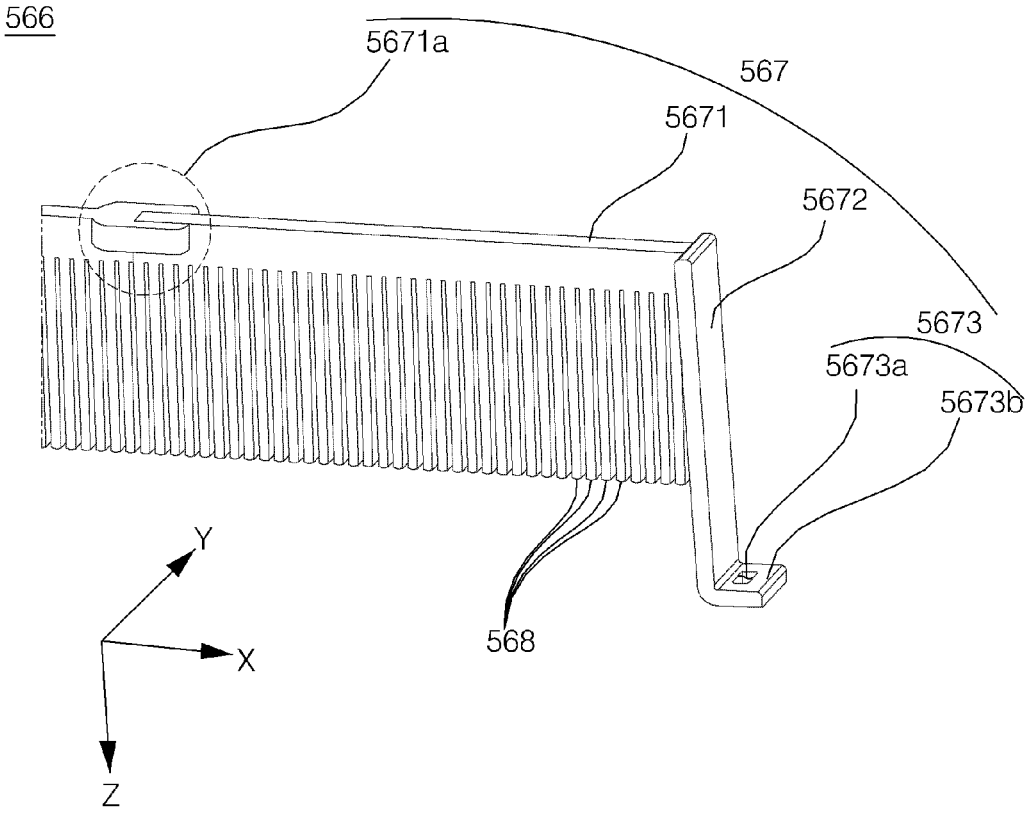
FIG. 21 is a partially enlarged perspective view showing the roof gap maintenance part of FIG. 18.
Figure 22:
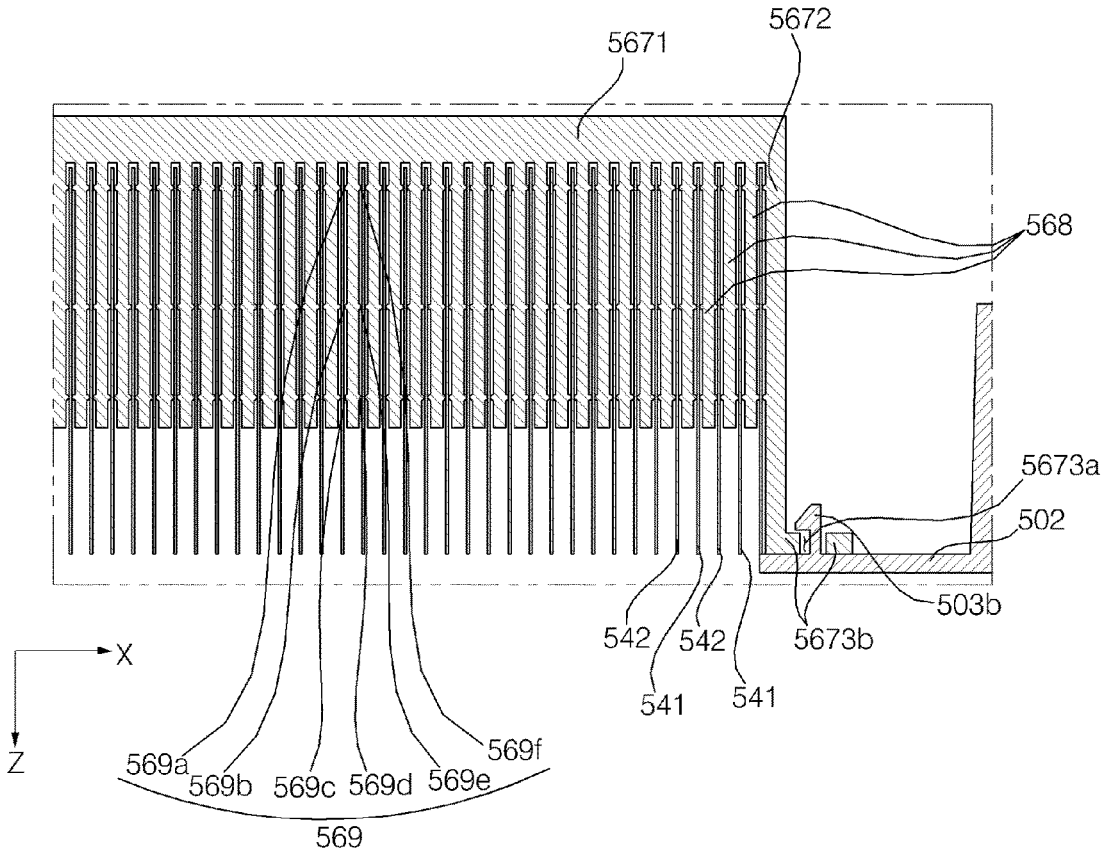
FIG. 22 is a partial sectional view showing the roof gap maintenance part of FIG. 18 when cut in the direction in which the films are arranged.

FIG. 18 is an enlarged perspective view showing the structure in which the base gap maintenance part 561 and the roof gap maintenance part 566 of FIG. 12 are coupled to the films 540*a* and the dust collection unit case 502. FIG. 19 is a partially enlarged perspective view showing the base gap maintenance part 561 of FIG. 18. FIG. 20 is a partial sectional view showing the base gap maintenance part 561 of FIG. 18 when cut in the direction X in which the films are arranged. FIG. 21 is a partially enlarged perspective view showing the roof gap maintenance part 566 of FIG. 18. FIG. 22 is a partial sectional view showing the roof gap maintenance part 566 of FIG. 18 when cut in the direction X in which the films are arranged.

Referring to FIGS. 18 to 22, the gap maintenance parts 561 and 566 include a plurality of vertical bars 564 and 568 configured to be inserted into the gaps S from the side of the films 540*a* at which the gap maintenance parts 561 and 566 are disposed. The vertical bars 564 and 568 extend in the direction in which the vertical bars 564 and 568 are inserted. The films 540*a* are spaced apart from each other by the vertical bars 564 and 568 such that the gaps S are maintained.

The vertical bars 564 and 568 may be inserted into the gaps S further inward than the middle portions of the films 540*a* in the lateral direction Z. As a result, the gaps S may be uniformly maintained at the middle portions of the films 540*a* as well as at the edges of the films 540*a*.

The base gap maintenance part 561 includes a plurality of base vertical bars 564 configured to be inserted into the gaps from one side of the films in the lateral direction Z. The roof gap maintenance part 566 includes a plurality of base vertical bars 568 configured to be inserted into the gaps from the other side of the films in the lateral direction Z. That is, the vertical bars 564 and 568 may include a plurality of base vertical bars 564 and a plurality of base vertical bars 568.

Protrusions 565 and 569 protruding toward the surfaces of the films 540*a* to reduce the gaps between the films 540*a* may be formed on the vertical bars 564 and 568. As a result, the gaps, by which the films 540*a* are disposed between the vertical bars 564 and 568, are narrowed, whereby the gaps between the films 540*a* are considerably reduced after the disposition of the films 540*a*.

A plurality of base gap maintenance parts 561 and/or a plurality of roof gap maintenance parts 566 may be provided. The base gap maintenance parts 561 and the roof gap maintenance parts 566 may be alternately arranged in the longitudinal direction Y of the films. In this case, when the group of films 540*a* is viewed in the longitudinal direction Y of the films, the base vertical bars 564 and the base vertical bars 568 partially overlap each other in the middle portions thereof. As a result, the gaps S between the films 540*a* may be more stably and uniformly maintained at the middle portions of the films 540*a*.

The base gap maintenance part 561 includes a base bar 562 disposed at one side of the films 540*a* in the lateral direction Z so as to extend in the direction X in which the films 540*a* are arranged, a plurality of base vertical bars 564 configured to be inserted into the gaps S from one side of the films in the lateral direction Z, and a fastening part 563 for fixing the base gap maintenance part 561 to the dust collection unit case 502. In this embodiment, one side of the films in the lateral direction Z is the upper side of the films, and the base bar 562 is disposed at the upper side of the films 540*a*.

The base bar 562 supports the proximal ends of the base vertical bars 564.

The base bar 562 may be disposed so as to divide the dust collection unit case outlet port 507. One side of the base bar 562 in the lateral direction Z of the films may face the direction in which air is discharged from the gaps, and the other side of the base bar 562 in the lateral direction Z of the films may contact the films 540*a*.

The base bar 562 may be a bar-type member. The base bar 562 extends in the direction X in which the films 540*a* are arranged.

One side of each of the films 540*a* in the lateral direction Z may be provided with a recess, into which a portion of the base bar 562 may be inserted and caught. In this case, the base bar 562 may directly fix the films 540*a*.

In this embodiment, the base bar 562 is provided at the opposite ends thereof in the direction X in which the films are arranged with fastening parts 563.

One of each fastening part 563 and the dust collection unit case 502 is provided with a fastening structure, and the other is provided with a corresponding structure. In this embodiment, a base hook 503*a* is formed on the inner surface of the dust collection unit case 502 in the direction in which the outlet port 507 is formed.

Each fastening part 563 includes a fastening plate 563*b* and a fastening hole 563*a* formed in the fastening plate 563*b* such that the base hook 503*a* is inserted and caught in the fastening hole 563*a*. The fastening plate 563*b* is disposed in the horizontal plane in the state of being in tight contact with the inner surface of the dust collection unit case 502. The fastening plate 563*b* and base bar 562 may be disposed in the same plane.

The proximal ends of the base vertical bars 564 are coupled to the base bar 562. The distal ends of the base vertical bars 564 are free ends.

The base vertical bars 564 may have the same length. The horizontal section of each base vertical bar 564 may have a rectangular shape that is longer in the longitudinal direction Y of the films than in the direction X in which the films are arranged.

The base vertical bars 564 are inserted into the gaps S further inward than the middle portions of the films 540*a* in the lateral direction Z. That is, the length of the base vertical bars 564 is greater than half the width of the films 540*a*. In addition, the length of the base vertical bars 564 may be less than or equal to the width of the films 540*a*.

The base vertical bars 564 and the films 540*a* are alternately arranged. One film 540*a* is disposed between two adjacent base vertical bars 564 of the base gap maintenance part 561. However, ones of the films 540*a* disposed at opposite ends thereof in the direction X in which the films are arranged may be disposed such that the base vertical bars 564 are located in the direction facing one side thereof but are not located in the direction facing the other side thereof.

Protrusions 565 protruding toward the surfaces of the films 540*a* to reduce the gaps between the films 540*a* may be formed on the base vertical bars 564.

In this embodiment, each protrusion 565 has a hemispherical shape. However, the present invention is not limited thereto.

The protrusions 565 may be formed on one side of each base vertical bar 564 in the direction X in which the films are arranged. Alternatively, the protrusions 565 may be formed on opposite sides of each base vertical bar 564 in the direction X in which the films are arranged. In the latter case, each film 540*a* is disposed between a protrusion 565 protruding from one base vertical bar 564 in one direction and a protrusion 565 protruding from another base vertical bar 564 adjacent thereto in the other direction.

The protrusions 565 may be provided at the middle portions of the films 540*a* in the lateral direction Z. The protrusions 565 may be arranged on the base vertical bars 564 so as to be spaced apart from each other in the lateral direction Z of the films.

FIG. 20 shows some of the protrusions 565. In this embodiment, the protrusions 565 include protrusions 565*a*, 565*b*, and 565*c* protruding from one side of each base vertical bar 564 in the direction X in which the films are arranged and protrusions 565*d*, 565*e*, and 565*f* protruding from the other side of each base vertical bar 564 in the direction X in which the films are arranged. The protrusions 565*c* and 565*d* formed at the proximal end of each base vertical bar 564, the protrusions 565*b* and 565*e* formed at the middle of each base vertical bar 564, and the protrusions 565*a* and 565*f* formed at the distal end of each base vertical bar 564 are arranged so as to be spaced apart from each other in the lateral direction Z of the films.

The roof gap maintenance part 566 may include a roof body 567 configured to cover the opposite ends of the films 540*a* in the direction X in which the films are arranged and the other side of the films 540*a* in the lateral direction Z of the films in a bracket shape. Alternatively, the roof gap maintenance part 566 may include a roof body 567 configured to cover the opposite ends of the films 540*a* in the direction X in which the films are arranged and the side of the films 540*a* distant from the inner surface of the dust collection unit case in a bracket shape. In this embodiment, the other side or the distant side is the lower side of the films, and the roof body 567 is disposed at the lower side of the films 540*a*.

The group of films is disposed in the space between the roof body 567 and the dust collection unit case 502. The portions of the roof body 567 located outside the group of films hold the group of films such that the shape of the group of films is maintained.

The roof gap maintenance part 566 may include a plurality of roof vertical bars 568 extending from the roof body 567 so as to be inserted into the gaps S.

The roof body 567 supports the proximal ends of the roof vertical bars 568.

The roof body 567 includes a roof bar 5671 extending in the direction X in which the films are arranged while contacting the films. The roof bar 5671 supports the proximal ends of the roof vertical bars 568.

The roof bar 5671 is disposed between the group of films 540*a* and the opposite electrode plates 523. One side of the roof bar 5671 in the lateral direction Z of the films may contact the films 540*a*, and the other side of the roof bar 5671 in the lateral direction Z of the films may contact the opposite electrode plates 523. The group of films 540*a* is spaced apart from the opposite electrode plates 523 by a distance equal to the thickness of the roof bar 5671 in the lateral direction Z of the films. The roof bar 5671 is disposed between the films 540*a* and the opposite electrode plates 523 such that the group of films 540*a* is spaced apart from the opposite electrode plates 523 by a predetermined distance.

The other side of each of the films 540*a* in the lateral direction Z may be provided with a recess, into which a portion of the roof bar 5671 may be inserted and caught. In this case, the roof bar 5671 may directly fix the films 540*a*.

The roof bar 5671 may be a bar-type member. The roof bar 5671 extends in the direction X in which the films 540*a* are arranged.

The roof bar 5671 may include at least one enlarged section part 5671*a* having a larger thickness than other parts. The enlarged section parts 5671*a* may be formed at the roof bar 5671 at equal intervals. Each enlarged section part 5671*a* increases the moment rigidity of the roof bar 5671.

The enlarged section part 5671*a* may be configured such that the thickness of the enlarged section part 5671*a* in the lateral direction Z of the films is substantially equal to the thickness of other parts in the lateral direction Z of the films and the thickness of the enlarged section part 5671*a* in the longitudinal direction Y of the films is greater than the thickness of other parts in the longitudinal direction Y of the films. The opposite electrode plates 523 may contact the roof bar 5671 in the lateral direction Z of the films such that the opposite electrode plates 523 reduce the deformation of the roof bar 5671 when moment force is applied to the roof bar 5671 in the lateral direction Z of the films. In addition, the length of the enlarged section part 5671*a* in the longitudinal direction Y of the films may be increased so as to reduce the deformation of the roof bar 5671 when moment force is applied to the roof bar 5671 in the longitudinal direction Y of the films.

The enlarged section part 5671*a* may be a connection part for interconnecting divided parts of the roof bar 5671. However, the present invention is not limited thereto. For the convenience of the assembly process, the roof gap maintenance part 566 may be divided into a plurality of parts, and the roof gap maintenance part 566 may be assembled by interconnecting the divided parts of the roof bar 5671. In this case, a protrusion formed on one part of the roof bar 5671 may be inserted into a recess formed in another part of the roof bar 5671. The enlarged section part 5671*a* may be configured such that the section of the coupling part of the protrusion and the recess is larger than the section of other parts of the roof bar 5671 in the state in which the roof gap maintenance part 566 is assembled.

The roof body 567 includes opposite end support parts 5672 disposed at the opposite ends thereof in the direction X in which the films are arranged so as to be coupled to the dust collection unit case 502. The opposite end support parts 5672 supports the opposite ends of the group of films in the direction X in which the films are arranged and, in addition, fix the roof gap maintenance part 566 to the dust collection unit case 502.

The opposite end support parts 5672 are coupled to the dust collection unit case 502 to support the roof bar 5671.

One opposite end support part 5672 is each end of the roof bar 5671 in the direction X in which the films are arranged. The opposite end support parts 5672 may be coupled to opposite ends of the roof bar 5671 in the direction X in which the films are arranged and may extend in the lateral direction Z of the films so as to contact the opposite ends of the group of films 540*a* in the direction X in which the films are arranged.

The opposite end support parts 5672 may include a first support part (not shown) coupled to one end of the roof bar 5671 and a second support part (not shown) coupled to the other end of the roof bar 5671. The first support part and the second support part may be bar-type members extending in the lateral direction Z of the films.

The horizontal section of the first support part and the second support part may have a shape that is longer in the longitudinal direction Y of the films than in the direction X in which the films are arranged. The horizontal section of the first support part and the second support part may have a substantially rectangular shape. The length of the horizontal section of the first support part and the second support part in the longitudinal direction Y of the films may be greater than the thickness of the roof bar 5671 in the longitudinal direction Y of the films and the thickness of the vertical bars 568 in the longitudinal direction Y of the films.

One end of each opposite end support part 5672 in the lateral direction Z of the films is coupled to the dust collection unit case 502. A fastening part 5673 is formed in the one end of each opposite end support part 5672 in the lateral direction Z of the films.

One of the fastening part 5673 and the dust collection unit case 502 is provided with a fastening structure, and the other is provided with a corresponding structure. In this embodiment, a roof hook 503*b* is formed on the inner surface of the dust collection unit case 502 in the direction in which the outlet port 507 is formed.

The fastening part 5673 includes a fastening plate 5673*b* and a fastening hole 5673*a* formed in the fastening plate 5673*b* such that the roof hook 503*b* is inserted and caught in the fastening hole 5673*a*. The fastening plate 5673*b* is disposed in the horizontal plane in the state of being in tight contact with the inner surface of the dust collection unit case 502.

The proximal ends of the roof vertical bars 568 are coupled to the roof bar 5671. The distal ends of the roof vertical bars 568 are free ends.

The roof vertical bars 568 may have the same length. The horizontal section of each roof vertical bar 568 may have a rectangular shape that is longer in the longitudinal direction Y of the films than in the direction X in which the films are arranged.

The roof vertical bars 568 are inserted into the gaps S further inward than the middle portions of the films 540*a* in the lateral direction Z. That is, the length of the roof vertical bars 568 is greater than half the width of the films 540*a*. In addition, the length of the roof vertical bars 568 may be less than or equal to the width of the films 540*a*.

The roof vertical bars 568 and the films 540*a* are alternately arranged. One film 540*a* is disposed between two adjacent roof vertical bars 568 of the roof gap maintenance part 566. However, gaps may be formed between ones of the roof vertical bars 568 disposed at opposite ends thereof in the direction X in which the films are arranged and the opposite end support parts 5672 such that a film 540*a* is inserted into each gap.

Protrusions 569 protruding toward the surfaces of the films 540*a* to reduce the gaps between the films 540*a* may be formed on the roof vertical bars 568.

In this embodiment, each protrusion 569 has a hemispherical shape. However, the present invention is not limited thereto.

The protrusions 569 may be formed on one side of each roof vertical bar 568 in the direction X in which the films are arranged. Alternatively, the protrusions 569 may be formed on opposite sides of each roof vertical bar 568 in the direction X in which the films are arranged. In the latter case, each film 540*a* is disposed between a protrusion 569 protruding from one roof vertical bar 568 in one direction and a protrusion 569 protruding from another roof vertical bar 568 adjacent thereto in the other direction.

The protrusions 569 may be provided at the middle portions of the films 540*a* in the lateral direction Z. The protrusions 569 may be arranged on the roof vertical bars 568 so as to be spaced apart from each other in the lateral direction Z of the films.

FIG. 22 shows some of the protrusions 569. In this embodiment, the protrusions 569 include protrusions 569*a*, 569*b*, and 569*c* protruding from one side of each roof vertical bar 568 in the direction X in which the films are arranged and protrusions 569*d*, 569*e*, and 569*f* protruding from the other side of each roof vertical bar 568 in the direction X in which the films are arranged. The protrusions 569*a* and 569*f* formed at the proximal end of each roof vertical bar 568, the protrusions 569*b* and 569*e* formed at the middle of each roof vertical bar 568, and the protrusions 569*c* and 569*d* formed at the distal end of each roof vertical bar 568 are arranged so as to be spaced apart from each other in the lateral direction Z of the films.

A plurality of base hooks 503*a* and a plurality of roof hooks 503*b* are alternately arranged at the opposite ends of the outlet port 507 in the direction X in which the films are arranged so as to be spaced apart from each other in the longitudinal direction Y of the films.

Figure 23:
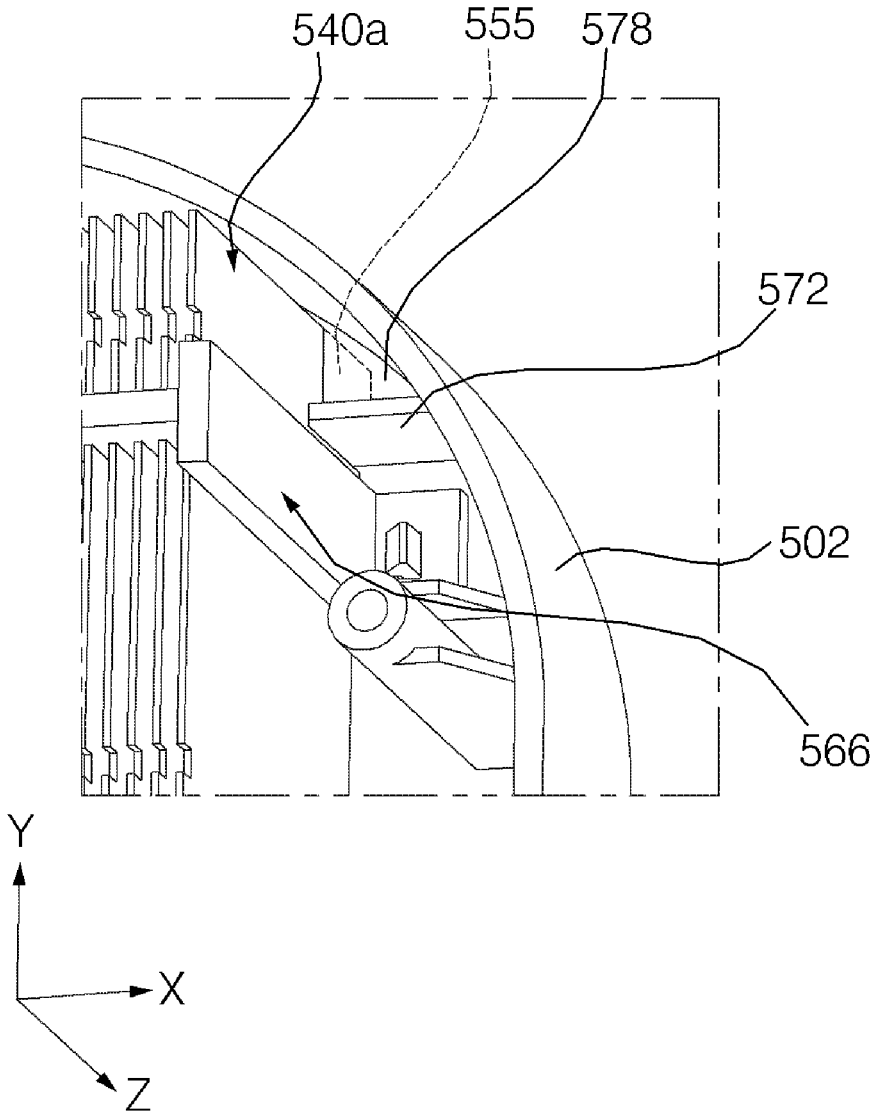
FIG. 23 is a partially enlarged perspective view showing the structure in which the films of FIG. 12 are held by holding ribs.
Figure 24:
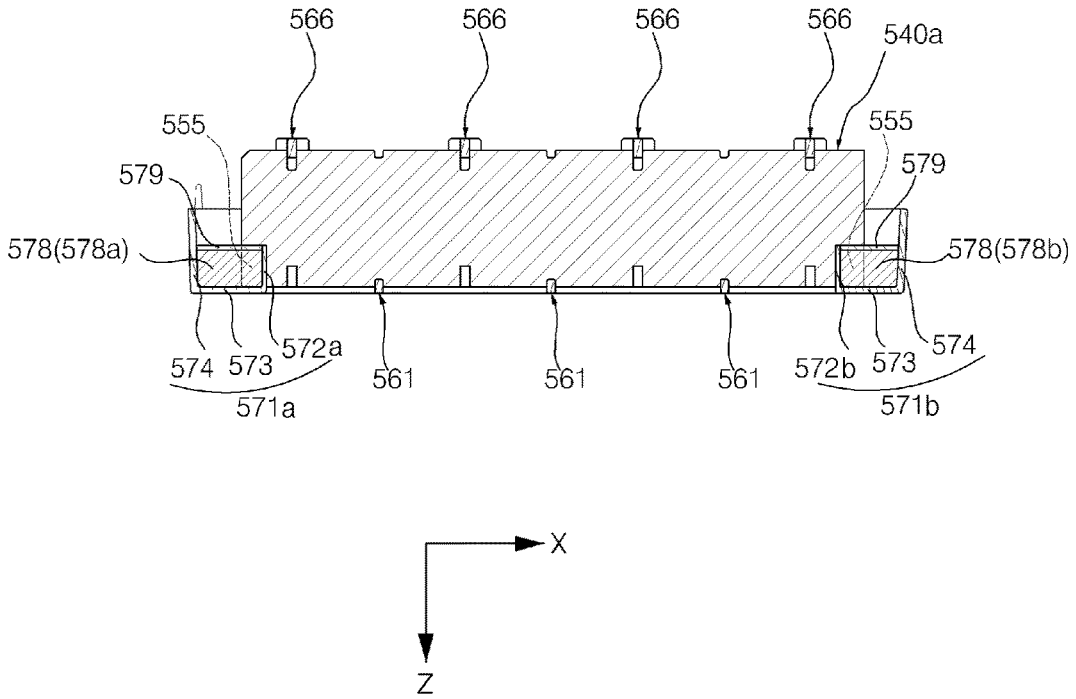
FIG. 24 is a sectional view showing the dust collection unit of FIG. 12 when cut in the longitudinal direction of the films.
Figure 25:
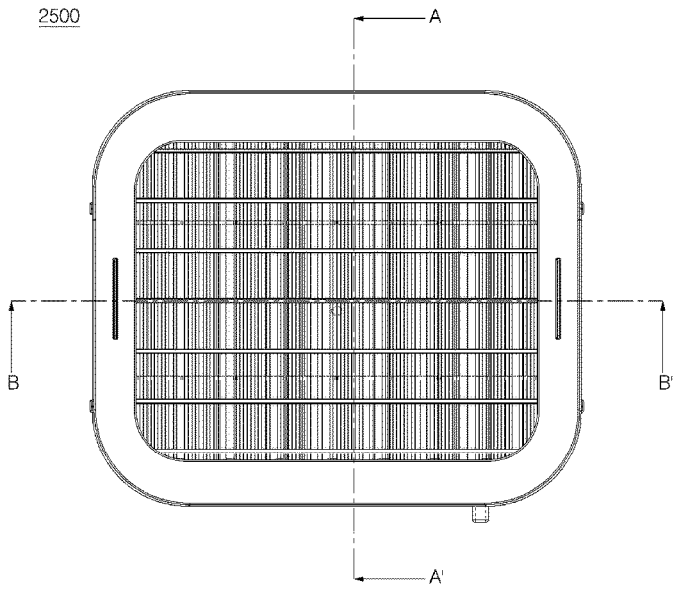
FIG. 25 is a top view showing an electric dust collector according to another embodiment of the present invention.
Figure 26:
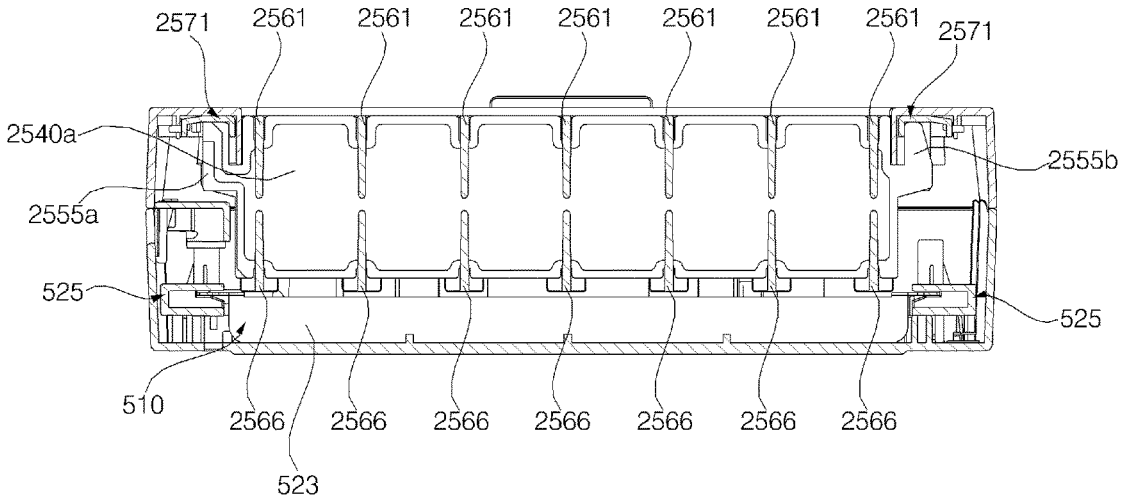
FIG. 26 is a sectional view taken along line A-A' of FIG. 25.
Figure 27:
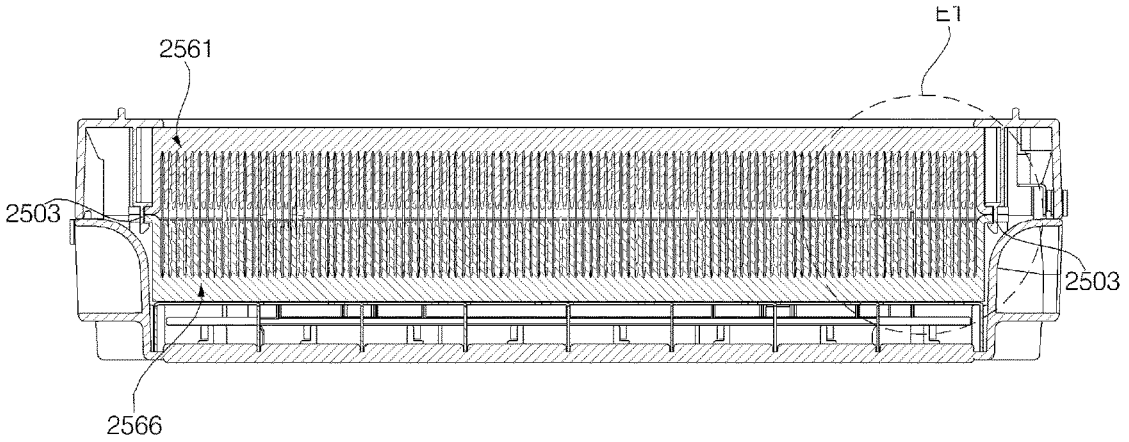
FIG. 27 is a sectional view taken along line B-B' of FIG. 25.

FIG. 23 is a partially enlarged perspective view showing the structure in which the films 540*a* of FIG. 12 are held by holding ribs 572. FIG. 24 is a sectional view showing the dust collection unit 540 of FIG. 12 when cut in the longitudinal direction Y of the films.

The fixing part 540*b* includes holding ribs 572, which are coupled to the dust collection unit case 502 and are inserted into the respective catching recesses 556.

The holding ribs 572 extend in the direction X in which the films are arranged. That is, the holding ribs 572 extend in the direction perpendicular to the films 540*a*.

The holding ribs 572 may include two ribs formed at opposite ends of the group of films in the longitudinal direction Y of the films so as to extend in the direction X in which the films are arranged. The holding ribs 572 include a first holding rib 572*a* disposed at one end of the group of films in the longitudinal direction Y of the films and a second holding rib 572*b* disposed at the other end of the group of films in the longitudinal direction Y of the films.

The fixing part 540*b* includes a conductor-receiving part 571 that defines a receiving space 576 for receiving the predetermined paste. The tips of the catching hooks 555, which are arranged along the opposite ends of the group of films in the longitudinal direction Y of the films so as to be aligned in the direction X in which the films are arranged, are inserted into the receiving space 576.

The conductor-receiving part 571 extends in the direction X in which the films are arranged. The conductor-receiving part 571 has two receiving spaces 576 formed at opposite ends of the group of films in the longitudinal direction Y of the films so as to extend in the direction X in which the films are arranged. The conductor-receiving part 571 includes a first conductor-receiving part 571*a* that defines a receiving space 576 for receiving the first electrode connection part 578*a* and a second conductor-receiving part 571*b* that defines a receiving space 576 for receiving the second electrode connection part 578*b*.

The catching hooks 555 are bent in the lateral direction Z of the films, are inserted into the receiving space 576, and are fixed by the molding part 578. The holding ribs 572 may be inserted into the catching recesses 556 so as to hold the films 540*a*, making the structure entirely stable. Thanks to the provision of the molding part 578 or the holding ribs 572/the catching recesses 556, the gap maintenance parts 560 merely maintain the gaps between the films 540*a* without supporting the films 540*a*. As a result, the weight and size of the gap maintenance parts 560 may be minimized.

The conductor-receiving part 571 may be provided with an opening, through which the predetermined paste is injected into the receiving space 576. In addition, the conductor-receiving part 571 may be provided with an opening, through which the exposed parts 557 and 558 are inserted into the receiving space 576. These two openings may be separately provided. Alternatively, a single opening that can perform both functions may be provided. In this embodiment, a single opening is provided.

The opening may be formed in one side of the conductor-receiving part 571 in the lateral direction Z of the films. In this embodiment, the opening formed in the conductor-receiving part 571 faces the direction in which the electrification unit 510 is located. One side of the conductor-receiving part 571 is opened and depressed to form the receiving space 576.

The conductor-receiving part 571 may include a bottom surface 573 that defines the lower surface of the receiving space 576, two transverse side surfaces (not shown) that define opposite side surfaces of the receiving space 576 in the direction X in which the films are arranged, and two longitudinal side surfaces 572 and 574 that define opposite side surfaces of the receiving space 576 in the longitudinal direction Y of the films.

The holding ribs 572 may constitute one surface that partitions the receiving space 576. That is, the holding ribs 572 may constitute a portion of the conductor-receiving part 571. In this embodiment, one of the longitudinal side surfaces into which the catching recesses 556 are fitted, i.e. the longitudinal side surface 572, defines the holding ribs 572. The first holding rib 572*a* constitutes a portion of the first conductor-receiving part 571*a*, and the second holding rib 572*b* constitutes a portion of the second conductor-receiving part 571*b*.

The other of the longitudinal side surfaces opposite the holding rib 572*a*, i.e. the longitudinal side surface 574, may be inclined in the lateral direction Z of the films. Consequently, the size of the receiving space 576 may be gradually increased toward the other side of the receiving space 576 in the lateral direction Z of the films.

The predetermined paste, which will constitute the molding part 578, fills the two receiving spaces 576, and is hardened to fix the catching hooks 555. The catching hooks 555 protrude while having a smaller area or width than the films 540*a*, whereby the catching hooks 555 are easily immersed in the molding part 578, and the molding part 578 efficiently fixes the films 540*a*.

In this embodiment, the molding part 578 is described as being the electrode connection part 578. In other embodiments, the molding part may be made of a material exhibiting no electrical conductivity.

The electrode connection part 578 may interconnect the exposed parts 557 or 558 formed at the first films 541 or the second films 542. The first electrode connection part 578*a* interconnects the exposed parts 557 formed at the first films 541, and the second electrode connection part 578*b* interconnects the exposed parts 558 formed at the second films 542. That is, the first electrode connection part 578*a* electrically interconnects the high-potential connection parts 557, and the second electrode connection part 578*b* electrically interconnects the low-potential connection parts 558.

The electrode connection part 578 fixes the catching hooks 555.

The first electrode connection part 578*a* fixes a catching hook 555 formed at one end of each of the first films 541 and the second films 542 in the longitudinal direction Y while being integrally coupled thereto. The second electrode connection part 578*b* fixes a catching hook 555 formed at the other end of each of the first films 541 and the second films 542 in the longitudinal direction Y while being integrally coupled thereto.

The first electrode connection part 578*a* fixes the catching hooks 555*a* of the first films 541 having the high-potential connection parts 557 and the catching hooks 555*b* of the second films 542 having no low-potential connection parts 558. The second electrode connection part 578*b* fixes the catching hooks 555*b* of the first films 541 having no high-potential connection part 557 and the catching hooks 555*a* of the second films 542 having the low-potential connection part 558. As a result, the first electrode connection part 578*a* may apply relatively high potential only to the conductive layers 551*a* of the first films, and the second electrode connection part 578*b* may apply relatively low potential only to the conductive layers 551*b* of the second films.

The electrode connection part 578 is formed by hardening the conductive paste. As a result, the electrode connection part 578 is joined to the high-potential connection parts 557 and the low-potential connection parts 558 while being in tight contact therewith so as to firmly fix the catching hooks 555, thereby minimizing contact resistance. In addition, the contact of air with the high-potential connection parts 557 and the low-potential connection parts 558 is prevented, thereby preventing the occurrence of sparks.

The conductive paste may be formed by mixing conductive powder, an organic solvent, and macromolecule resin. The conductive paste is in a semi-solid state before hardening and is in a solid state after hardening.

The conductive powder is obtained by pulverizing conductive solid material into small particles. The conductive solid material may be a metal, such as carbon, copper, or silver. In this embodiment, the conductive powder is a carbon black powder.

The organic solvent is liquid at room temperature. When the organic solvent mixed with the conductive powder is evaporated according to predetermined drying conditions, the conductive powder is hardened to form a solid.

The macromolecule resin is provided in the form of powder. The conductive powder and the macromolecule resin remain unchanged even after the conductive paste is hardened. The conductive powder and the macromolecule resin are mixed with each other but are not chemically coupled to each other. After the conductive paste is hardened, the particles of the conductive powder are connected to each other. As a result, the hardened conductive paste may exhibit electrical conductivity.

The conductive paste may include about 30% of conductive powder, about 50% of an organic solvent, and about 20% of macromolecule resin. However, the present invention is not limited thereto.

The electrode connection part 578 is disposed so as to be watertightly covered. In an embodiment, a waterproof material 579 may be applied to the surface of the electrode connection part 578 that is exposed to external air. The waterproof material 579 may include epoxy resin or urethane resin. However, the present invention is not limited thereto. The waterproof material 579 is not particularly restricted as long as the waterproof material can be hardened.

In this embodiment, the waterproof material may be formed by mixing the main material with a hardening agent. The main material includes bisphenol A-type epoxy resin, a non-flammable filler, and other additives. The hardening agent is aliphatic amine modified hardener.

The waterproof material 579 is applied to the surface of the electrode connection part 578 exposed through the opening of the conductor-receiving part 571. In the state in which the conductive paste fills the receiving space 576, the waterproof material 579 is disposed so as to cover the surface of the conductive paste that is exposed to external air. The electrode connection part 578 is disposed so as to be covered by the conductor-receiving part 571 and the waterproof material 579.

In other embodiments, the surface of the electrode connection part 578 that is exposed to external air may be covered by a cap member (not shown). The cap member may be disposed so as to cover the top surface of the receiving space 576. The electrode connection part 578 is disposed so as to be covered by the conductor-receiving part 571 and the cap member.

Hereinafter, a method of manufacturing the electric dust collector using the conductive paste will be described with reference to FIG. 13. The predetermined paste may be classified into conductive paste having electrical conductivity and paste having no electrical conductivity. In the following description, the paste having no electrical conductivity may be referred to as 'predetermined paste' rather than the 'conductive paste.'

The method of manufacturing the electric dust collector includes (a) disposing the films 540*a* at predetermined positions, (b) injecting the conductive paste such that the exposed parts 557 and 558 are immersed in the conductive paste, (c) hardening the injected conductive paste according to predetermined drying conditions, (d) applying the waterproof material to the surface of the hardened conductive paste that is exposed to external air, and (e) hardening the waterproof material according to predetermined drying conditions.

At step (a), a step of disposing the surface of the dust collection unit case 502 having the outlet port 507 so as to contact the floor such that the inner space of the dust collection unit case 502 faces upward is performed.

Subsequently, a step of disposing the base gap maintenance parts 561 at predetermined positions in the dust collection unit case 502 such that the base vertical bars 564 protrude upward is performed. The fastening parts 563 of the base gap maintenance parts 561 are coupled to the corresponding base hooks 503*a*, whereby the base gap maintenance parts 561 are fixed to the dust collection unit case 502.

Subsequently, a step of inserting the holding ribs 572 into the catching recesses 556 of the films 540*a* and inserting the films 540*a* between the respective base vertical bars 564 of the base gap maintenance parts 561 such that the films 540*a* are disposed at the predetermined positions is performed. When the films 540*a* are disposed at the predetermined positions, the tips of the insertions parts 555 are inserted into the receiving space 576.

Subsequently, a step of disposing the roof gap maintenance parts 566 at predetermined positions in the dust collection unit case 502 such that the films 540*a* are inserted between the respective roof gap maintenance parts 566 is performed. The fastening parts 5673 of the roof gap maintenance parts 566 are coupled to the corresponding roof hooks 503*b*, whereby the roof gap maintenance parts 566 are fixed to the dust collection unit case 502.

In the case in which each roof gap maintenance part 566 is divided into a plurality of parts by the connection parts (the enlarged section parts) of the roof bar 5671, at the step of disposing the roof gap maintenance parts, each divided part of each roof gap maintenance part 566 is temporarily disposed such that the films 540*a* are inserted between the roof vertical bars 568 of each divided part of each roof gap maintenance part 566, and the divided parts of each roof gap maintenance part 566 are assembled such that the roof gap maintenance parts 566 are located in position. When the films 540*a* are inserted between the roof vertical bars 568 of the roof gap maintenance parts 566, it is necessary to pay careful attention. As a result, the process may be more easily and conveniently performed.

The step of disposing the roof gap maintenance parts may be performed during or after step (b) or step (c). However, the step of disposing the roof gap maintenance parts may be performed before step (b) such that the films 540*a* can be more accurately disposed before the conductive paste is injected.

Subsequently, step (b) is performed. At step (b), the conductive paste is injected into the receiving space 576 such that the tips of the catching hooks 555 are immersed in the conductive paste. That is, the conductive paste is injected into the receiving space 576 such that the exposed parts 557 and 558 can be entirely immersed in the conductive paste.

Subsequently, step (c) is performed. At step (c), the injected conductive paste is hardened according to the predetermined drying conditions, i.e. paste drying temperature and paste drying time. The paste drying temperature and the paste drying time may be changed depending on the composition and mixing ratio of the conductive paste. The paste drying temperature may be 75° C. or less and the paste drying time may be 180 minutes or less in order to prevent deformation of the films 540*a*.

Subsequently, step (d) is performed. A waterproofing material is applied to the surface of the hardened conductive paste that is exposed to external air, i.e. the open surface of the receiving space 576

Subsequently, step (e) is performed. At step (e), the applied waterproofing material is hardened according to the predetermined drying conditions, i.e. waterproofing material drying temperature and waterproofing material drying time. The waterproofing material drying temperature and the waterproofing material drying time may be changed depending on the composition and mixing ratio of the waterproof material. In this embodiment, the waterproofing material drying temperature is 60° C. or less, and the waterproofing material drying time is 180 minutes or less.

Hereinafter, an electric dust collector 2500 according to another embodiment will be described with reference to FIGS. 25 to 34. The components of the electric dust collector 2500 according to this embodiment that are identical to those of the electric dust collector 500 according to the previous embodiment are denoted by the same reference numerals, and a description thereof will be omitted.

The electric dust collector 2500 includes an electrification unit 510 for electrifying dust particles in the air, a dust collection unit 540 for collecting the dust particles electrified by the electrification unit 510, and a dust collection unit case 2502 for receiving the dust collection unit 540.

The dust collection unit 540 includes a plurality of films 540*a*, having conductive layers 551*a* and 551*b* to which insulative layers 552*a* and 552*b* are applied, and a fixing part 540*b* for fixing the films 540*a* in the dust collection unit case 2502. Catching hooks 2555*a* and 2555*b* of the films 540*a* may be formed so as to protrude while having a smaller width than the films 540*a* in the longitudinal direction Y of the films 540*a*.

Each of the films 540*a* may be formed in the shape of a band that is longer in the longitudinal direction Y than in the lateral direction Z. The films 540*a* may be arranged so as to face each other such that gaps S are formed between the respective films. The films 540*a* may be arranged side by side to form a film group.

The fixing part 540*b* includes a pair of gap maintenance parts 2560 disposed on opposite sides of the films 540*a* in the lateral direction Z of the films 540*a* for maintaining the gaps.

Each gap maintenance part 2560 includes a base gap maintenance part 2561, disposed at one side of the films 540*a* in the lateral direction Z, and a roof gap maintenance part 2566, disposed at the other side of the films 540*a* in the lateral direction Z.

Each gap maintenance part 2560 includes a plurality of vertical bars 2568 configured to be inserted into the gaps S from one side of the group of films 540*a*. The base gap maintenance part 2561 includes a plurality of first vertical bars 2568-1 configured to be inserted into the gaps S from one side of the group of films 540*a*. The roof gap maintenance part 2566 includes a plurality of second vertical bars 2568-2 configured to be inserted into the gaps S from the other side of the group of films 540*a*.

The vertical bars 2568 may be inserted up to the middle portions of the films 540*a* in the lateral direction Z. The first vertical bars 2568-1 may be inserted up to the middle portions of the films 540*a* in the lateral direction Z. The second vertical bars 2568-2 may be inserted up to the middle portions of the films 540*a* in the lateral direction Z.

Figure 28:
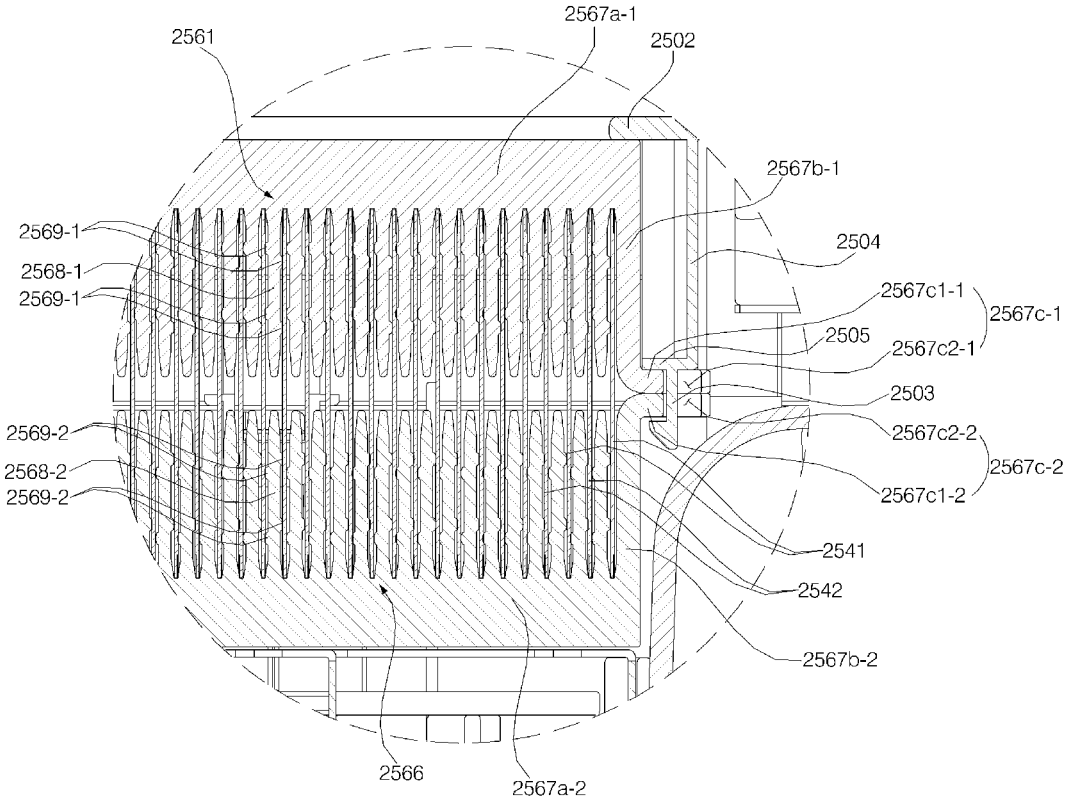
FIG. 28 is an enlarged view showing part E1 of FIG. 27.
Figure 29:
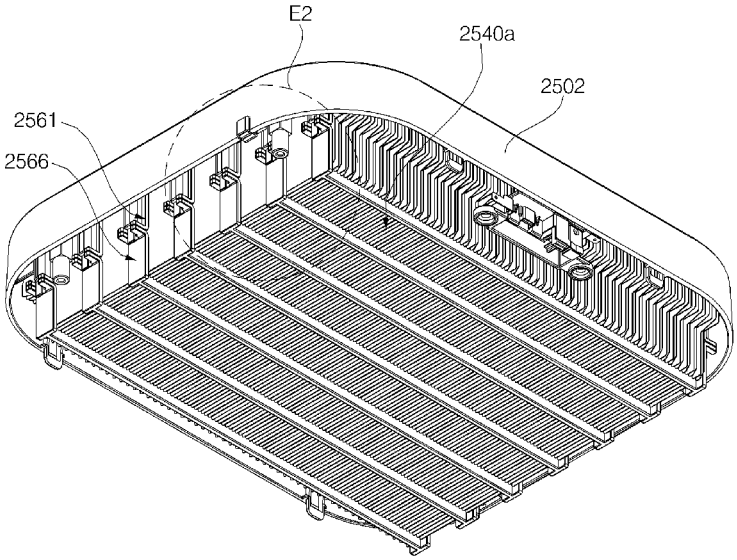
FIG. 29 is a perspective view showing the electric dust collector of FIG. 25 with an electrification unit thereof removed.
Figure 30:
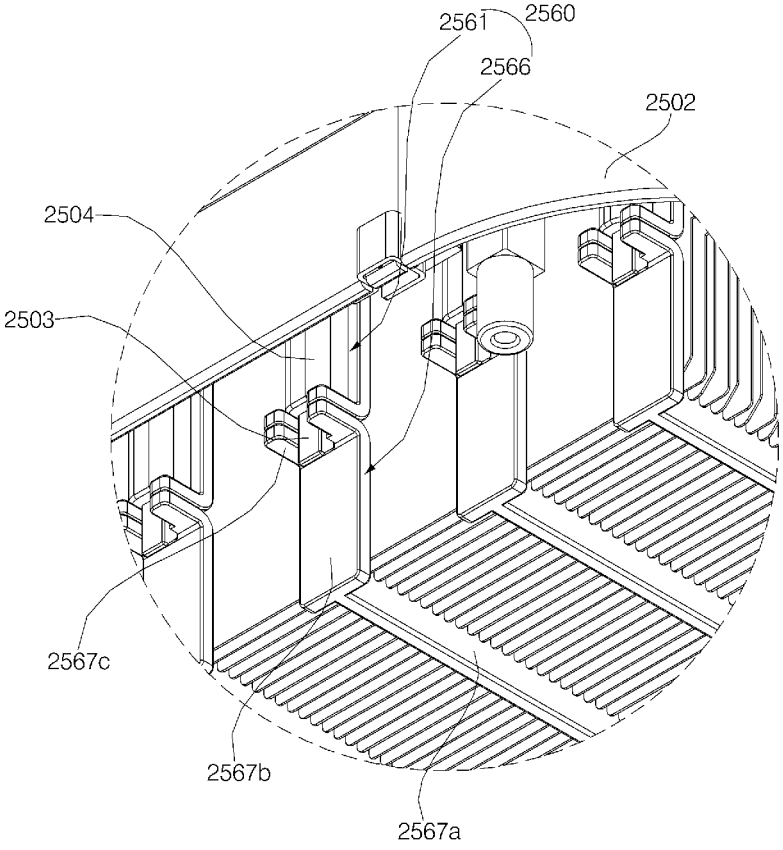
FIG. 30 is an enlarged view showing part E2 of FIG. 29.
Figure 31:
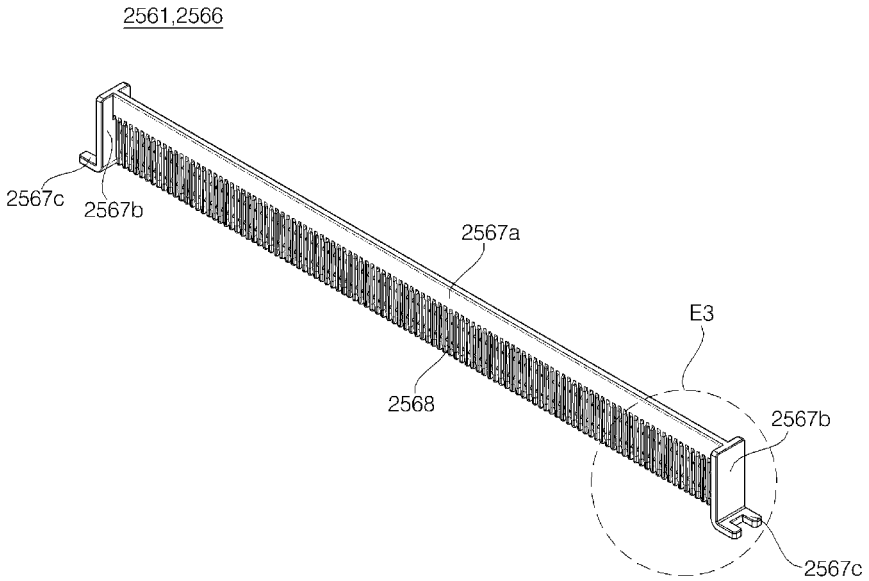
FIG. 31 is a perspective view showing gap maintenance parts according to another embodiment shown in FIG. 29.
Figure 32:
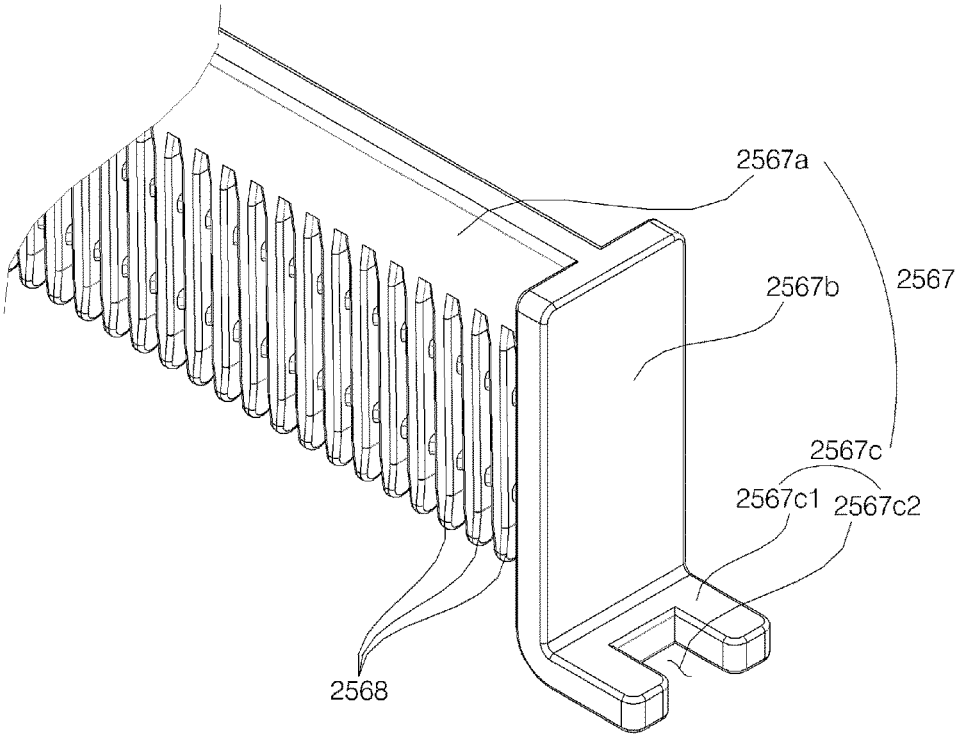
FIG. 32 is an enlarged view showing part E3 of FIG. 31.
Figure 33:
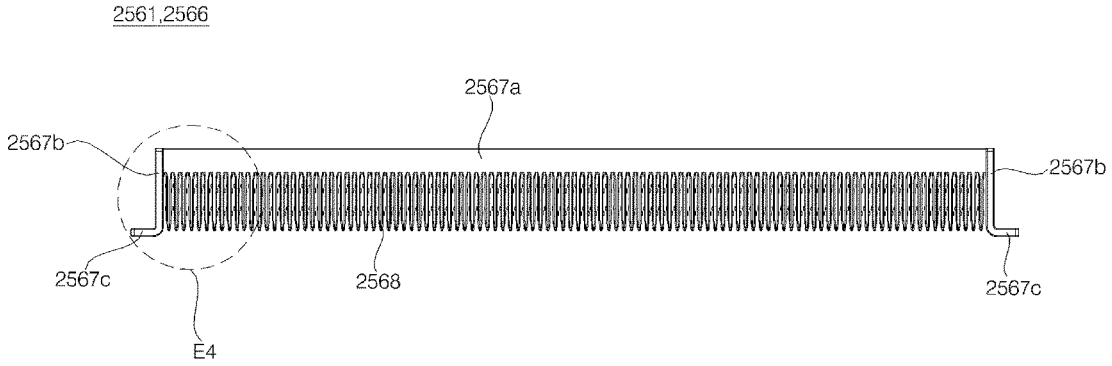
FIG. 33 is an elevation view showing the gap maintenance parts of FIG. 31.
Figure 34:
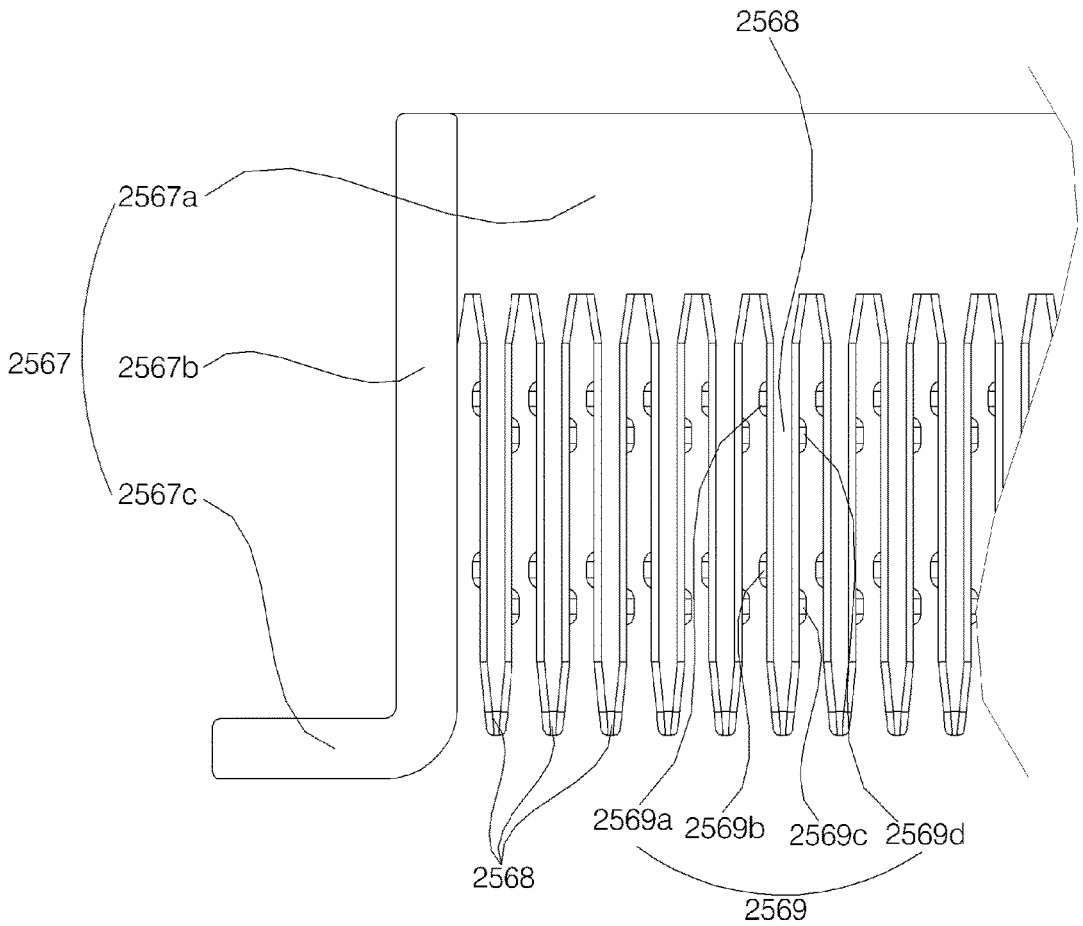
FIG. 34 is an enlarged view showing part E4 of FIG. 33.

The base gap maintenance part 2561 and the roof gap maintenance part 2566 may be arranged so as to be symmetric with respect to the lateral middle portion of the group of films 540*a*. Referring to FIG. 28, the opposite ends of first films 2541 and second films 2542 in the lateral direction Z may contact the base gap maintenance part 2561 and the roof gap maintenance part 2566.

The base gap maintenance part 2561 and the roof gap maintenance part 2566 may have the same shape. Hereinafter, the base gap maintenance part 2561 and the roof gap maintenance part 2566 will be described as having the same shape. FIGS. 31 to 34 show the structure of the base gap maintenance part 2561 and the roof gap maintenance part 2566. However, the present invention is not limited thereto.

Protrusions 2569 protruding toward the surfaces of the films 540*a* to reduce the gaps between the films 540*a* may be formed on the vertical bars 2568. Protrusions 2569 protruding toward the surfaces of the films 540*a* to reduce the gaps between the films 540*a* may be formed on the first vertical bars 2568-1 and the second vertical bars 2568-2. First protrusions 2569-1 are formed on the first vertical bars 2568-1, and second protrusions 2569-2 are formed on the second vertical bars 2568-2.

A plurality of protrusions 2569*a* and 2569*b* protruding in one direction may be formed on each of the vertical bars 2568 in the state of being spaced apart from each other. In addition, a plurality of protrusions 2569*c* and 2569*d* protruding in the other direction may be formed on each of the vertical bars 2568 in the state of being spaced apart from each other. The protrusions 2569*a* and 2569*d*, which protrude in opposite directions, may be disposed so as not to be aligned with each other. In addition, the protrusions 2569*b* and 2569*c*, which protrude in opposite directions, may be disposed so as not to be aligned with each other.

A plurality of gap maintenance parts 2560 may be arranged at intervals in the longitudinal direction Y of the films 540*a*.

The gap maintenance part 2560 includes a gap maintenance body 2567 for covering the opposite ends of the group of films in the direction X in which the films are arranged and one side of the group of films in the lateral direction Z. The gap maintenance body 2567 supports the proximal ends of vertical bars 2568.

The base gap maintenance part 2561 may include a first gap maintenance body 2567 for covering the opposite ends of the group of films in the direction X in which the films are arranged and one side of the group of films in the lateral direction Z and supporting the proximal ends of the first vertical bars 2568-1. The roof gap maintenance part 2566 may include a second gap maintenance body 2567 for covering the opposite ends of the group of films in the direction X in which the films are arranged and the other side of the group of films in the lateral direction Z and supporting the proximal ends of the second vertical bars 2568-2.

The gap maintenance body 2567 may include opposite end support parts 2567*b* disposed at the opposite ends of the group of films in the direction X in which the films are arranged and coupled to the dust collection unit case 2502, a horizontal bar 2567*a* extending in the direction X in which the films are arranged while contacting the group of films, and fastening parts 2567*c* for fixing the gap maintenance part 2560 to the dust collection unit case 2502.

Referring to FIG. 28, the first gap maintenance body 2567 may include first opposite end support parts 2567*b*-1 disposed at opposite ends of the group of films in the direction X in which the films are arranged and coupled to the dust collection unit case 2502, a first horizontal bar 2567*a*-1 extending in the direction X in which the films are arranged while contacting the group of films, and first fastening parts 2567*c*-1 for fixing the base gap maintenance part 2561 to the dust collection unit case 2502.

Referring to FIG. 28, the second gap maintenance body 2567 may include second opposite end support parts 2567*b*-2 disposed at the opposite ends of the group of films in the direction X in which the films are arranged and coupled to the dust collection unit case 2502, a second horizontal bar 2567*a*-2 extending in the direction X in which the films are arranged while contacting the group of films, and second fastening parts 2567*c*-2 for fixing the roof gap maintenance part 2562 to the dust collection unit case 2502.

The dust collection unit case 2502 includes hooks 2503, on which the first fastening parts 2567*c*-1 and the second fastening parts 2567*c*-2 are caught in the state in which the first fastening parts 2567*c*-1 and the second fastening parts 2567*c*-2 contact each other. One of the first fastening parts 2567*c*-1 and a corresponding one of the second fastening parts 2567*c*-2 are caught on a corresponding hook 2503 in the state in which the first fastening part 2567*c*-1 and the second fastening part 2567*c*-2 contact each other.

Each fastening part 2567*c* includes a fastening plate 2567*c*1 configured to contact another fastening part 2567*c*. The fastening plate 2567*c*1 is provided with a hook recess 2567*c*2, into which a corresponding hook 2503 is inserted and caught.

Each first fastening part 2567*c*-1 includes a first fastening plate 2567*c*1-1 configured to contact a corresponding second fastening part 2567*c*-2. The first fastening plate 2567*c*1-1 is provided with a hook recess 2567*c*2-1, into which a corresponding hook 2503 is inserted and caught.

Each second fastening part 2567*c*-2 includes a second fastening plate 2567*c*1-2 configured to contact a corresponding first fastening part 2567*c*-1. The second fastening plate 2567*c*1-2 is provided with a hook recess 2567*c*2-2, into which a corresponding hook 2503 is inserted and caught.

The dust collection unit case 2502 includes hook fixing parts 2504 for supporting and fixing the hooks 2503. One end of each of the hook fixing parts 2504 is fixed to the dust collection unit case 2502, and the other end of each of the hook fixing parts 2504 protrudes up to the middle portion of the group of films 540*a* in the lateral direction Z so as to be connected to a corresponding hook 2503.

The dust collection unit case 2502 includes fixing plates 2505 having steps for supporting the fastening parts 2567*c* between the hooks 2503 and the hook fixing parts 2504 while contacting the fastening parts 2567*c*. In this embodiment, each fixing plate 2505 has a step that contacts the first fastening part 2567*c*-1, as shown in FIG. 28.

As is apparent from the above description, according to the present invention, the gaps between the respective films are uniformly maintained, whereby the electric field generated in the gaps between the respective films is uniform.

It is possible to accurately and rapidly manufacture the electric dust collector thanks to the provision of the holding ribs, the molding part, and the gap maintenance parts.

It is possible to stably maintain the gaps between the films while not disturbing the flow of air through the outlet port thanks to the provision of the gap maintenance parts.

It is possible to uniformly maintain the gaps between the films at the middle portions of the films as well as at the edges of the films thanks to the provision of the fixing part.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electric dust collector comprising:

a dust collector to collect electrified dust particles; and a dust collector case receiving the dust collector, wherein the dust collector comprises a plurality of films to generate an electric field and a fixing part to fix the films in the dust collector case, each of the films is longer than wide, the plurality of films arranged to face each other such that gaps are formed between adjacent films, each of the films has a catching recess formed in at least one end thereof in a longitudinal direction (Y) of the films so as to be depressed in a lateral direction (Z), wherein the fixing part comprises:

a gap maintenance part disposed at a first side of the plurality of films in a lateral direction (Z) of the films to maintain the gaps, a plurality of holding ribs coupled to the dust collector case and inserted into the respective catching recesses, and a molding part to fix the films, the molding part formed of a hardened predetermined paste coupled with a portion of each of the films, and wherein the gap maintenance part comprises a plurality of vertical bars disposed inside the gaps, wherein each of the vertical bars comprises a protrusion that protrudes from the vertical bars toward the films to reduce the gaps between the films, wherein each of the catching recesses is formed in the shape of a slit that is opened at one side of the films, wherein the holding ribs and the catching recesses are formed to be engaged with each other.

2. The electric dust collector of claim 1, wherein the gap maintenance part comprises a plurality of gap maintenance parts spaced apart from each other in the longitudinal direction (Y) of the films.

3. The electric dust collector of claim 1, wherein the films are arranged side by side to face each other.

4. The electric dust collector of claim 1, wherein each of the vertical bars includes a protrusion that protrudes from the vertical bars toward surfaces of the films to reduce the gaps between the films.

5. The electric dust collector of claim 1, wherein the gap maintenance part comprises a base gap maintenance part disposed at the first side of the films in the lateral direction (Z) of the films and a roof gap maintenance part disposed at a second side of the films in the lateral direction (Z) of the films, the base gap maintenance part comprises a plurality of first vertical bars inserted into the gaps from the first side of the films, and the roof gap maintenance part comprises a plurality of second vertical bars inserted into the gaps from the second side of the films.

6. The electric dust collector of claim 5, wherein the base gap maintenance part and the roof gap maintenance part are symmetric with respect to a middle portion of the films in the lateral direction (Z) of the films.

7. The electric dust collector of claim 5, wherein the base gap maintenance part and the roof gap maintenance part have the same shape.

8. The electric dust collector of claim 5, wherein each of the first and second vertical bars is provided with a protrusion that protrudes toward the films to reduce the gaps between the films.

9. The electric dust collector of claim 5, wherein the base gap maintenance part comprises a first gap maintenance body that covers opposite ends of the films in a width direction (X) of the films in which the films are arranged and the first side of the films, and supports proximal ends of the first vertical bars, and the roof gap maintenance part comprises a first gap maintenance body that covers opposite ends of the films in the width direction (X) of the films in which the films are arranged and the second side of the films, and supports proximal ends of the second vertical bars.

10. The electric dust collector of claim 9, wherein the first gap maintenance body comprises first opposite end support parts disposed at the opposite ends of films in the width direction (X) of the films in which the films are arranged and coupled to the dust collector case, and the second gap maintenance body comprises second opposite end support parts disposed at the opposite ends of the films in the width direction (X) of the films in which the films are arranged and coupled to the dust collector case.

11. The electric dust collector of claim 9, wherein the first gap maintenance body comprises a first horizontal bar that extends in the width direction (X) of the films in which the films are arranged and contacts the films, and the second gap maintenance body comprises a second horizontal bar that extends in the width direction (X) of the films in which the films are arranged and contacts the films.

12. The electric dust collector of claim 9, wherein the first gap maintenance body comprises a first fastening part to fasten the base gap maintenance part to the dust collector case, the second gap maintenance body comprises a second fastening part to fasten the roof gap maintenance part to the dust collector case, and the dust collector case comprises a hook that is inserted with the first fastening parts and the second fastening parts.

13. The electric dust collector of claim 1, wherein the vertical bars in the gaps extend inward toward middle portions of the films in the lateral direction (Z) of the films.

14. The electric dust collector of claim 1, wherein the gap maintenance part comprises a base gap maintenance part disposed at the first side of the films in the lateral direction (Z) of the films and a roof gap maintenance part disposed at a second side of the films in the lateral direction (Z) of the films, the base gap maintenance part comprises a plurality of base vertical bars inserted into the gaps from the first side of the films in the lateral direction (Z) of the films, the roof gap maintenance part comprises a plurality of roof vertical bars inserted into the gaps from the second side of the films in the lateral direction (Z) of the films, and the base vertical bars and the roof vertical bars in the gaps extend inward toward middle portions of the films in the lateral direction (Z) of the films.

15. The electric dust collector of claim 14, wherein a plurality of at least one of the base gap maintenance part and the roof gap maintenance part are alternately arranged and spaced apart from each other in the longitudinal direction (Y) of the films.

16. The electric dust collector of claim 14, wherein the roof gap maintenance part comprises a roof body to cover opposite ends of the films in the width direction (X) of the films in which the films are arranged and the another side of the films, and supporting proximal ends of the roof vertical bars.

17. The electric dust collector of claim 1, wherein the gap maintenance part comprises a roof gap maintenance part disposed at one of opposite sides of the films in the lateral direction (Z) of the films that is further from an inner surface of the dust collector case than the other, and the roof gap maintenance part comprises a roof body to cover opposite ends of the films in the width direction (X) of the films in which the films are arranged and the one side of the films that is further from the inner surface of the dust collector case in the lateral direction (Z) than the other.

18. The electric dust collector of claim 17, wherein the roof body comprises an opposite end support part disposed at each of the opposite ends of the roof body in the width direction (X) of the films in which the films are arranged, the opposite end support parts being coupled to the dust collector case.

19. The electric dust collector of claim 17, wherein the roof body comprises a roof bar that extends in the width direction (X) of the films in which the films are arranged and contacts the films, and the roof bar is formed having a varying thickness.

20. The electric dust collector of claim 1, wherein the films are fixed to the fixing part via the hardened predetermined paste of the molding part.

* * * * *